US011380243B1

(12) United States Patent
Lai et al.

(10) Patent No.: US 11,380,243 B1
(45) Date of Patent: Jul. 5, 2022

(54) SHIFT REGISTER HAVING TWO OUTPUT SIGNALS WITH PHASE LAGGING AND DRIVING METHOD THEREOF, SCAN DRIVING CIRCUIT, DISPLAY PANEL AND DISPLAY DEVICE

(71) Applicant: Xiamen Tianma Micro-Electronics Co., Ltd., Xiamen (CN)

(72) Inventors: Qingjun Lai, Xiamen (CN); Yihua Zhu, Xiamen (CN); Shaorong Yu, Shanghai (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/212,323

(22) Filed: Mar. 25, 2021

(30) Foreign Application Priority Data

Jan. 5, 2021 (CN) ..... 202110009334.5

(51) Int. Cl.
*G09G 5/00* (2006.01)
*G09G 3/20* (2006.01)

(52) U.S. Cl.
CPC ... *G09G 3/2092* (2013.01); *G09G 2310/0286* (2013.01); *G09G 2310/061* (2013.01); *G09G 2310/08* (2013.01)

(58) Field of Classification Search
CPC ..... G09G 3/2092; G09G 2310/0296; G09G 2310/061; G09G 2310/08
See application file for complete search history.

(56) References Cited

U.S. PATENT DOCUMENTS

| | | | | |
|---|---|---|---|---|
| 10,204,545 | B2 * | 2/2019 | Park | G09G 3/3266 |
| 10,950,157 | B1 * | 3/2021 | Kim | G09G 3/3266 |
| 10,997,923 | B2 * | 5/2021 | Lim | G09G 3/3258 |
| 2014/0028534 | A1 * | 1/2014 | Park | G09G 3/20 345/84 |
| 2017/0084222 | A1 * | 3/2017 | Sun | G09G 3/32 |
| 2017/0116911 | A1 * | 4/2017 | Shim | G09G 3/3266 |
| 2017/0287404 | A1 * | 10/2017 | Kim | G09G 3/3266 |
| 2020/0193911 | A1 * | 6/2020 | Lim | G09G 3/3258 |
| 2021/0065632 | A1 * | 3/2021 | Kim | G09G 3/3275 |

FOREIGN PATENT DOCUMENTS

CN 107424649 A 12/2017

* cited by examiner

*Primary Examiner* — Adam J Snyder

(74) *Attorney, Agent, or Firm* — Anova Law Group, PLLC

(57) ABSTRACT

The present disclosure provides a shift register and a driving method thereof, a scan driving circuit, a display panel, and a display device. The shift register includes an input module; a control module; a reset module; a first output module; a second output module; and a stabilization module, that a phase of a signal output from the second output module lags behind a phase of a signal output from the first output module, and does not overlap with the phase of the signal output from the first output module.

16 Claims, 16 Drawing Sheets

SHIFT REGISTER HAVING TWO OUTPUT SIGNALS WITH PHASE LAGGING AND DRIVING METHOD THEREOF, SCAN DRIVING CIRCUIT, DISPLAY PANEL AND DISPLAY DEVICE

CROSS-REFERENCE TO RELATED APPLICATION

This application claims the priority of Chinese Patent Application No. CN202110009334.5, filed on Jan. 5, 2021, the entire contents of all of which are incorporated herein by reference.

FIELD OF THE DISCLOSURE

The present disclosure generally relates to the field of display technologies and, in particular, relates to a shift register and a driving method thereof, a scan driving circuit, a display panel, and a display device.

BACKGROUND

With development of electronic technologies, display panels have been widely used in various electronic products in various fields, such as televisions, mobile phones, computers, personal digital assistants, and other electronic products, becoming an indispensable part of people's life and work.

Existing display panels scan multiple rows of pixels in a pixel array through a scan driving circuit located in a non-display area, to drive the pixel array to display images. However, due to a relatively large layout space occupied by the scan driving circuit, a proportion of the non-display area in the display panels cannot be further reduced, which is not conducive to realization of a full screen.

BRIEF SUMMARY OF THE DISCLOSURE

One aspect of the present disclosure provides a shift register, including: an input module, electrically connected to a signal input terminal and a first clock signal terminal, and configured to provide a signal of the signal input terminal to a first node in response to a signal of the first clock signal terminal; a control module, electrically connected to a first voltage terminal, a second clock signal terminal, and a second node, and configured to provide a voltage of the first voltage terminal to the first node in response to a voltage of the second node and a signal of the second clock signal terminal; a reset module, electrically connected to a second voltage terminal and the first clock signal terminal, and configured to provide a voltage of the second voltage terminal to the second node in response to the signal of the first clock signal terminal; a first output module, electrically connected to the first node and the second clock signal terminal, and configured to provide the signal of the second clock signal terminal to a first output terminal in response to the voltage of the first node; a second output module, electrically connected to the first node and a third clock signal terminal, and configured to provide a signal of the third clock signal terminal to a second output terminal in response to the voltage of the first node; and a stabilization module, electrically connected to the second node and the first voltage terminal, and configured to provide the voltage of the first voltage terminal to the first output terminal and the second output terminal respectively in response to the voltage of the second node, that a phase of a signal output from the second output module lags behind a phase of a signal output from the first output module, and does not overlap with the phase of the signal output from the first output module.

Another aspect of the present disclosure provides a driving method of the disclosed shift register, including: in a first stage, the signal input terminal inputs a low level, the first clock signal terminal inputs a low level, the second clock signal terminal inputs a high level, and the third clock signal terminal inputs a high level, configured to provide the low level input from the signal input terminal to the first node, and provide the low level input from the first clock signal terminal to the second node, so that the first output terminal and the second output terminal both output high levels; in a second stage, the signal input terminal inputs a high level, the first clock signal terminal inputs a high level, the second clock signal terminal inputs a low level, and the third clock signal terminal inputs a high level, configured to provide the high level input from the first clock signal terminal to the second node, so that the first output terminal outputs a low level, and the second output terminal outputs a high level; in a third stage, the signal input terminal inputs a high level, the first clock signal terminal inputs a high level, the second clock signal terminal inputs a high level, and the third clock signal terminal inputs a low level, configured to provide the high level input from the first clock signal terminal to the second node, so that the first output terminal outputs a high level, and the second output terminal outputs a low level; and in a fourth stage, the signal input terminal inputs a high level, the first clock signal terminal inputs a low level, the second clock signal terminal inputs a high level, and the third clock signal terminal inputs a high level, configured to provide the high level input from the input signal terminal to the first node, and provide a low level of the second voltage terminal to the second node, so that the first output terminal and the second output terminal both output high levels.

Another aspect of the present disclosure provides a scan driving circuit, including: shift registers, arranged in a cascaded manner, that each of the shift registers includes: an input module, electrically connected to a signal input terminal and a first clock signal terminal, and configured to provide a signal of the signal input terminal to a first node in response to a signal of the first clock signal terminal; a control module, electrically connected to a first voltage terminal, a second clock signal terminal, and a second node, and configured to provide a voltage of the first voltage terminal to the first node in response to a voltage of the second node and a signal of the second clock signal terminal; a reset module, electrically connected to a second voltage terminal and the first clock signal terminal, and configured to provide a voltage of the second voltage terminal to the second node in response to the signal of the first clock signal terminal; a first output module, electrically connected to the first node and the second clock signal terminal, and configured to provide the signal of the second clock signal terminal to a first output terminal in response to the voltage of the first node; a second output module, electrically connected to the first node and a third clock signal terminal, and configured to provide a signal of the third clock signal terminal to a second output terminal in response to the voltage of the first node; and a stabilization module, electrically connected to the second node and the first voltage terminal, and configured to provide the voltage of the first voltage terminal to the first output terminal and the second output terminal respectively in response to the voltage of the second node, that a phase of a signal output from the second output module lags behind a phase of a signal output from the first output module, and does not overlap with the phase of the signal output from the first output module; an initial signal line; a first clock signal line; a second clock signal line; and a third clock signal line, that the signal input terminal of a first-stage shift register is electrically connected to the initial signal line; except for the first-stage shift register, the signal input terminal of each stage shift register is electrically connected to one of the second output terminal and the first output terminal of a previous stage shift register; for a 3n-th stage shift register, a first clock signal terminal thereof is electrically connected to the first clock signal line, a second clock signal terminal thereof is electrically connected to the second clock signal line, and a third clock signal terminal thereof is electrically connected to the third clock signal line; for a 3n+1st stage shift register, a first clock signal terminal thereof is electrically connected to the third clock signal line, a second clock signal terminal thereof is electrically connected to the first clock signal line, and a third clock signal terminal thereof is electrically connected to the second clock signal line; for a 3n+2nd stage shift register, a first clock signal terminal thereof is electrically connected to the second clock signal line, a second clock signal terminal thereof is electrically connected to the third clock signal line, and a third clock signal terminal thereof is electrically connected to the first clock signal line; and pulses of the first clock signal line, the second clock signal line, and the third clock signal line do not overlap with each other, and are arranged sequentially in time, that n is 0 or a positive integer.

Another aspect of the present disclosure provides a display panel, including: a scan driving circuit, including: shift registers, arranged in a cascaded manner, that each of the shift registers includes: an input module, electrically connected to a signal input terminal and a first clock signal terminal, and configured to provide a signal of the signal input terminal to a first node in response to a signal of the first clock signal terminal; a control module, electrically connected to a first voltage terminal, a second clock signal terminal, and a second node, and configured to provide a voltage of the first voltage terminal to the first node in response to a voltage of the second node and a signal of the second clock signal terminal; a reset module, electrically connected to a second voltage terminal and the first clock signal terminal, and configured to provide a voltage of the second voltage terminal to the second node in response to the signal of the first clock signal terminal; a first output module, electrically connected to the first node and the second clock signal terminal, and configured to provide the signal of the second clock signal terminal to a first output terminal in response to the voltage of the first node; a second output module, electrically connected to the first node and a third clock signal terminal, and configured to provide a signal of the third clock signal terminal to a second output terminal in response to the voltage of the first node; and a stabilization module, electrically connected to the second node and the first voltage terminal, and configured to provide the voltage of the first voltage terminal to the first output terminal and the second output terminal respectively in response to the voltage of the second node, that a phase of a signal output from the second output module lags behind a phase of a signal output from the first output module, and does not overlap with the phase of the signal output from the first output module; an initial signal line; a first clock signal line; a second clock signal line; and a third clock signal line, that the signal input terminal of a first-stage shift register is electrically connected to the initial signal line; except for the first-stage shift register, the signal input terminal of each stage shift register is electrically connected to one of the second output terminal and the first output terminal of a previous stage shift register; for a 3n-th stage shift register, a first clock signal terminal thereof is electrically connected to the first clock signal line, a second clock signal terminal thereof is electrically connected to the second clock signal line, and a third clock signal terminal thereof is electrically connected to the third clock signal line; for a 3n+1st stage shift register, a first clock signal terminal thereof is electrically connected to the third clock signal line, a second clock signal terminal thereof is electrically connected to the first clock signal line, and a third clock signal terminal thereof is electrically connected to the second clock signal line; for a 3n+2nd stage shift register, a first clock signal terminal thereof is electrically connected to the second clock signal line, a second clock signal terminal thereof is electrically connected to the third clock signal line, and a third clock signal terminal thereof is electrically connected to the first clock signal line; and pulses of the first clock signal line, the second clock signal line, and the third clock signal line do not overlap with each other, and are arranged sequentially in time, that n is 0 or a positive integer; a plurality of scan signal lines; and a plurality of pixel driving circuits, that the first output terminal and the second output terminal of the shift registers of the scan driving circuit are electrically connected to the plurality of scan signal lines; and the plurality of scan signal lines is electrically connected to the plurality of pixel driving circuits.

Another aspect of the present disclosure provides a display device, including: the disclosed display panel.

Other aspects of the present disclosure can be understood by those skilled in the art in light of the description, the claims, and the drawings of the present disclosure.

BRIEF DESCRIPTION OF THE DRAWINGS

To more clearly illustrate the technical solution of the present disclosure, the accompanying drawings used in the description of the disclosed embodiments are briefly described hereinafter. The following drawings are merely examples for illustrative purposes according to various disclosed embodiments and are not intended to limit the scope of the present disclosure. Other drawings may be derived from such drawings by a person with ordinary skill in the art without creative efforts.

DETAILED DESCRIPTION

Figure 1:
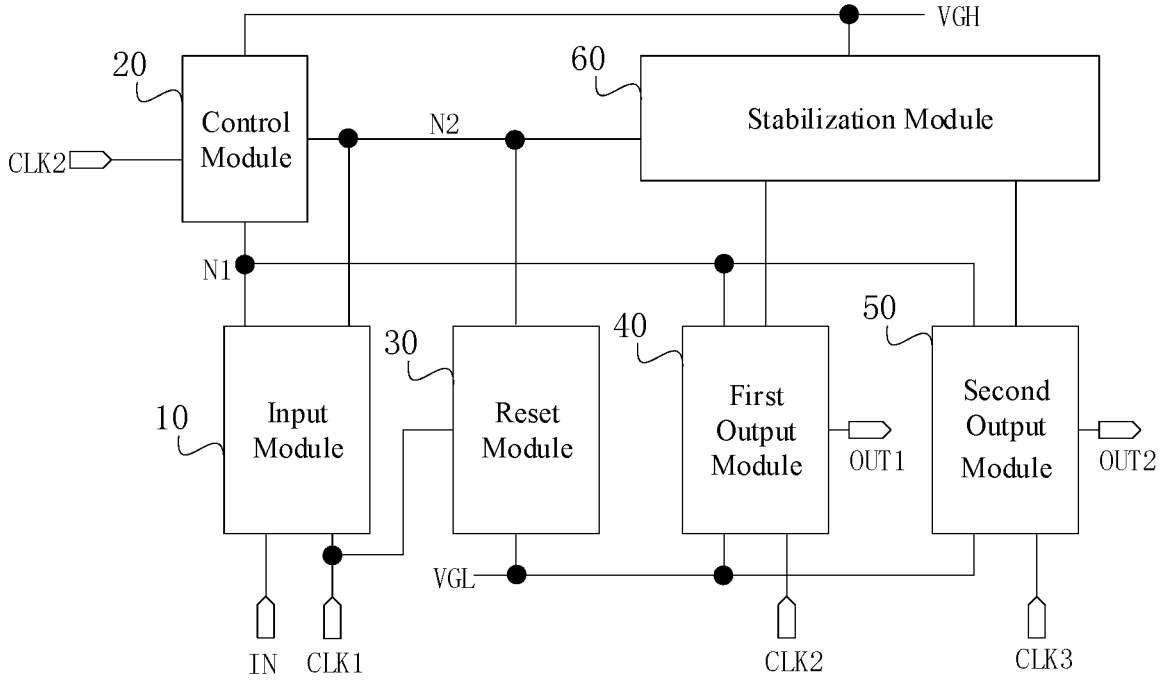
FIG. 1 is a schematic structural view of an exemplary shift register according to various embodiments of the present disclosure.

As described in the background, in existing display panels, a layout space of a scan driving circuit is relatively large. The scan driving circuit includes a plurality of cascaded shift registers. An output terminal of each shift register is electrically connected to a gate line. The plurality of shift registers scans multiple rows of pixels, through outputting scan signals to a plurality of gate lines respectively. Since each shift register can only output a scan signal to one gate line, the layout space of the multiple shift registers, that is, the scan driving circuit, is relatively large.

Based on this, the present disclosure provides a shift register and a driving method thereof, a scan driving circuit, a display panel, and a display device to overcome the above-mentioned problems. The shift register includes:

an input module, electrically connected to a signal input terminal and a first clock signal terminal, and configured to provide a signal of the signal input terminal to a first node in response to a signal of the first clock signal terminal;

a control module, electrically connected to a first voltage terminal, a second clock signal terminal, and a second node, and configured to provide a voltage of the first voltage terminal to the first node in response to a voltage of the second node and a signal of the second clock signal terminal;

a reset module, electrically connected to a second voltage terminal and the first clock signal terminal, and configured to provide a voltage of the second voltage terminal to the second node in response to the signal of the first clock signal terminal;

a first output module, electrically connected to the first node and the second clock signal terminal, and configured to provide the signal of the second clock signal terminal to a first output terminal in response to the voltage of the first node;

a second output module, electrically connected to the first node and a third clock signal terminal, and configured to provide a signal of the third clock signal terminal to a second output terminal in response to the voltage of the first node; and a stabilization module, electrically connected to the second node and the first voltage terminal, and configured to provide the voltage of the first voltage terminal to the first output terminal and the second output terminal respectively in response to the voltage of the second node.

A phase of a signal output from the second output module lags behind a phase of a signal output from the first output module, and does not overlap with the phase of the signal output from the first output module.

Due to action of the same input module, control module, and reset module, the first output module and the second output module can output two signals respectively, and the phase of the signal output from the second output module lags behind the phase of the signal output from the first output module, and does not overlap with the phase of the signal output from the first output module. Therefore, the signals output from the first output module and the second output module can be electrically connected to two gate lines respectively to scan two rows of pixels separately. Compared with the solution of scanning two rows of pixels through two shift registers in the prior art, the solution of scanning two rows of pixels through one shift register in the present disclosure greatly reduces a layout area of the scan driving circuit.

The above is the core idea of the present disclosure. To make the above objectives, features, and advantages of the present disclosure clearer and easier to understand, the technical solutions in the embodiments of the present disclosure will be clearly and completely described in conjunction with the accompanying drawings in the embodiments of the present disclosure. The described embodiments are only a part of the embodiments of the present disclosure, rather than all the embodiments. Based on the embodiments of the present disclosure, all other embodiments obtained by those of ordinary skill in the art without creative work shall fall within the protection scope of the present disclosure.

The embodiments of the present disclosure provide a shift register. FIG. 1 is a schematic structural view of an exemplary shift register according to various embodiments of the present disclosure. As shown in FIG. 1, the shift register includes an input module 10, a control module 20, a reset module 30, a first output module 40, a second output module 50, and a stabilization module 60.

The input module 10 is electrically connected to a signal input terminal IN and a first clock signal terminal CLK1, and is configured to provide a signal of the signal input terminal IN to a first node N1 in response to a signal of the first clock signal terminal CLK1.

The control module 20 is electrically connected to a first voltage terminal VGH, a second clock signal terminal CLK2, and a second node N2, and is configured to provide a voltage of the first voltage terminal VGH to the first node N1 in response to a voltage of the second node N2 and a signal of the second clock signal terminal CLK2.

The reset module 30 is electrically connected to a second voltage terminal VGL and the first clock signal terminal CLK1 to provide a voltage of the second voltage terminal VGL to the second node N2 in response to the signal of the first clock signal terminal CLK1.

The first output module 40 is electrically connected to the first node N1 and the second clock signal terminal CLK2, and is configured to provide the signal of the second clock signal terminal CLK2 to a first output terminal OUT1 in response to the voltage of the first node N1.

The second output module 50 is electrically connected to the first node N1 and a third clock signal terminal CLK3, and is configured to provide a signal of the third clock signal terminal CLK3 to a second output terminal OUT2 in response to the voltage of the first node N1.

The stabilization module 60 is electrically connected to the second node N2 and the first voltage terminal VGH, and is configured to provide the voltage of the first voltage terminal VGH to the first output terminal OUT1 and the second output terminal OUT2 in response to the voltage of the second node N2.

In addition, a phase of a signal output from the second output module 50 lags behind a phase of a signal output from the first output module 40, and the phase of the signal output from the second output module 50 does not overlap with the phase of the signal output from the first output module 40. That is, a phase of a signal output from the second output terminal OUT2 lags behind a phase of a signal output from the first output terminal OUT1, and the phase of the signal output from the second output terminal OUT2 does not overlap with the phase of the signal output from the first output terminal OUT1.

Due to action under the same input module 10, control module 20, and reset module 30, the first output module 40 and the second output module 50 can respectively output two signals, and the phase of the signal output from the second output module 50 lags behind the phase of the signal output from the first output module 40, and does not overlap with the phase of the signal output from the first output module 40. Therefore, the signals output from the first output module 40 and the second output module 50 can be electrically connected to two gate lines respectively to scan two rows of pixels respectively.

Compared with the solution of scanning two rows of pixels through two shift registers in the prior art, the solution of scanning two rows of pixels through one shift register in the present disclosure greatly reduces the layout area of the scan driving circuit. Therefore, a layout space occupation ratio of the scan driving circuit is reduced, so that a non-display area in the display panel can be further reduced, which is more conducive to realization of a full screen.

In addition, in response to the voltage of the second node N2, the stabilization module 60 in the present disclosure provides the voltage of the first voltage terminal VGH to the first output terminal OUT1 and the second output terminal OUT2, respectively, so that when the output signal of the first output terminal OUT1 and the output signal of the second output terminal OUT2 are high levels, stable outputs of the first output terminal OUT1 and the second output terminal OUT2 are ensured.

Figure 2:
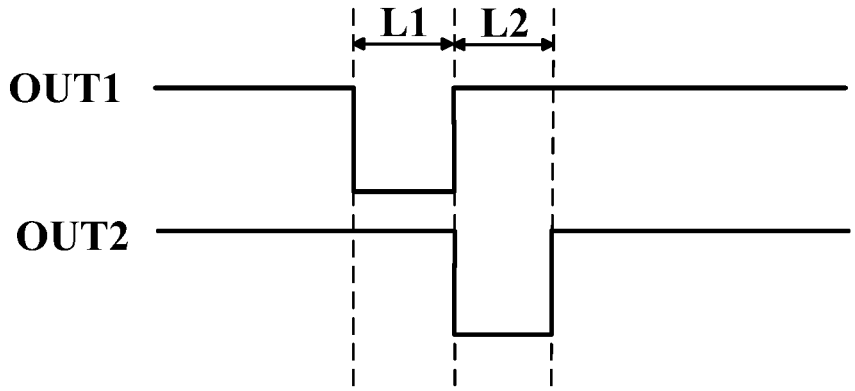
FIG. 2 is a timing diagram of a signal output from a second output module and a signal output from a first output module according to various embodiments of the present disclosure.

FIG. 2 is a timing diagram of a signal output from a second output module and a signal output from a first output module according to various embodiments of the present disclosure. In some embodiments of the present disclosure, as shown in FIG. 2, a pulse width L2 of the signal output from the second output module 50 is equal to a pulse width L1 of the signal output from the first output module 40, so that there is no difference in signal characteristics between two signals successively output from a same shift register.

The present disclosure is not limited to this. In practical applications, under influence of factors such as manufacturing process differences and circuit leakage currents, the pulse width of the signal output from the second output module 50 may also be slightly different from the pulse width of the signal output from the first output module 40, or, according to different application requirements, the pulse width L2 of the signal output from the second output module 50 may be different from the pulse width L1 of the signal output from the first output module 40, which will not be repeated here.

In some application scenarios that there is no high requirement for the layout area of the scan driving circuit, that is, in some display panels with a larger applicable scan driving circuit layout space, the first output terminal OUT1 and the second output terminal OUT2 can be provided to pixel driving circuits of a row of pixels as different driving signals of the pixel driving circuits.

Figure 3:
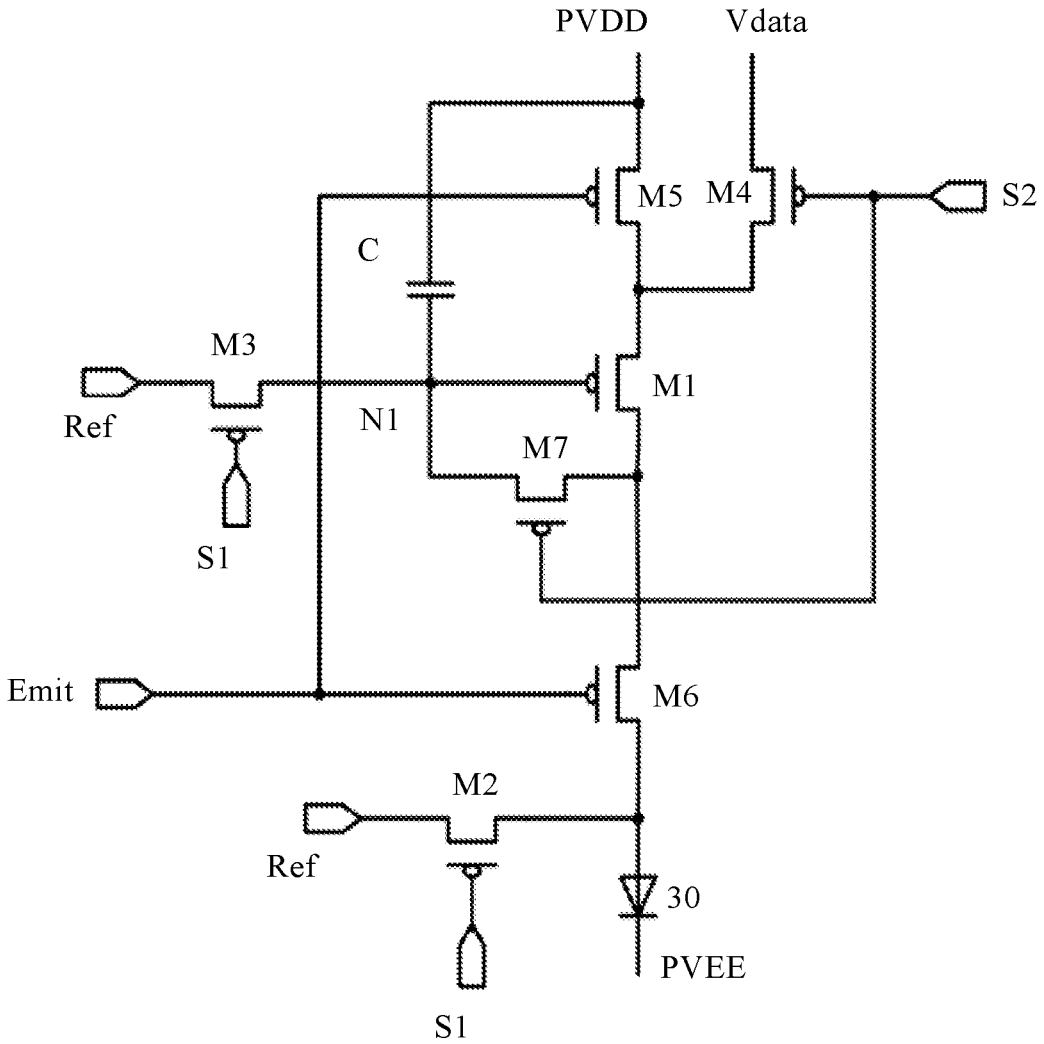
FIG. 3 is a schematic structural view of an exemplary pixel driving circuit according to various embodiments of the present disclosure.

FIG. 3 is a schematic structural view of an exemplary pixel driving circuit according to various embodiments of the present disclosure. As shown in FIG. 3, a pixel driving circuit includes transistors M1 to M6, which drive a light emitting device 30 to emit light, under control of input signals of input terminals S1, S2, Ref, and Emit. The light emitting device 30 may be an LED or an OLED or the like.

Figure 4:
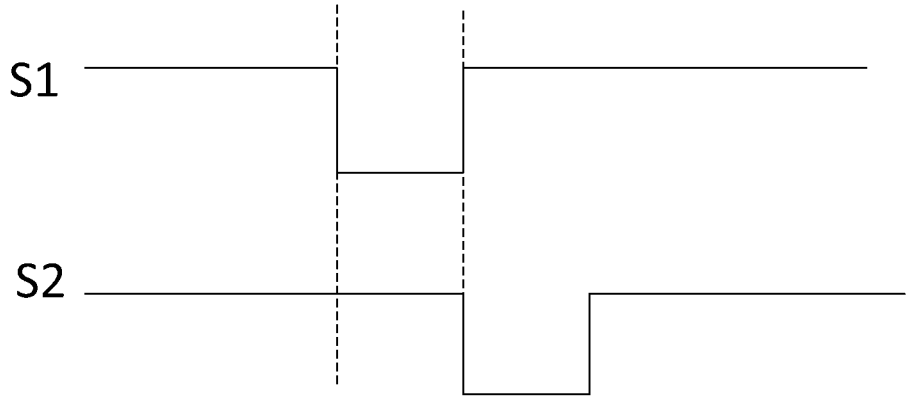
FIG. 4 is a timing diagram of signals input from an input terminal S1 and an input terminal S2 in an exemplary pixel driving circuit shown in FIG. 3.

FIG. 4 is a timing diagram of signals input from an input terminal S1 and an input terminal S2 in an exemplary pixel driving circuit shown in FIG. 3. As shown in FIG. 4, a phase of a signal input from the input terminal S2 lags behind a phase of a signal input from the input terminal S1, and the phase of the signal input from the input terminal S1 does not overlap the phase of the signal input from the input terminal S2. Therefore, the signal output from the second output terminal OUT2 can be used as the signal input from the input terminal S2, and the signal output from the first output terminal OUT1 can be used as the signal input from the input terminal S1.

Figure 5:
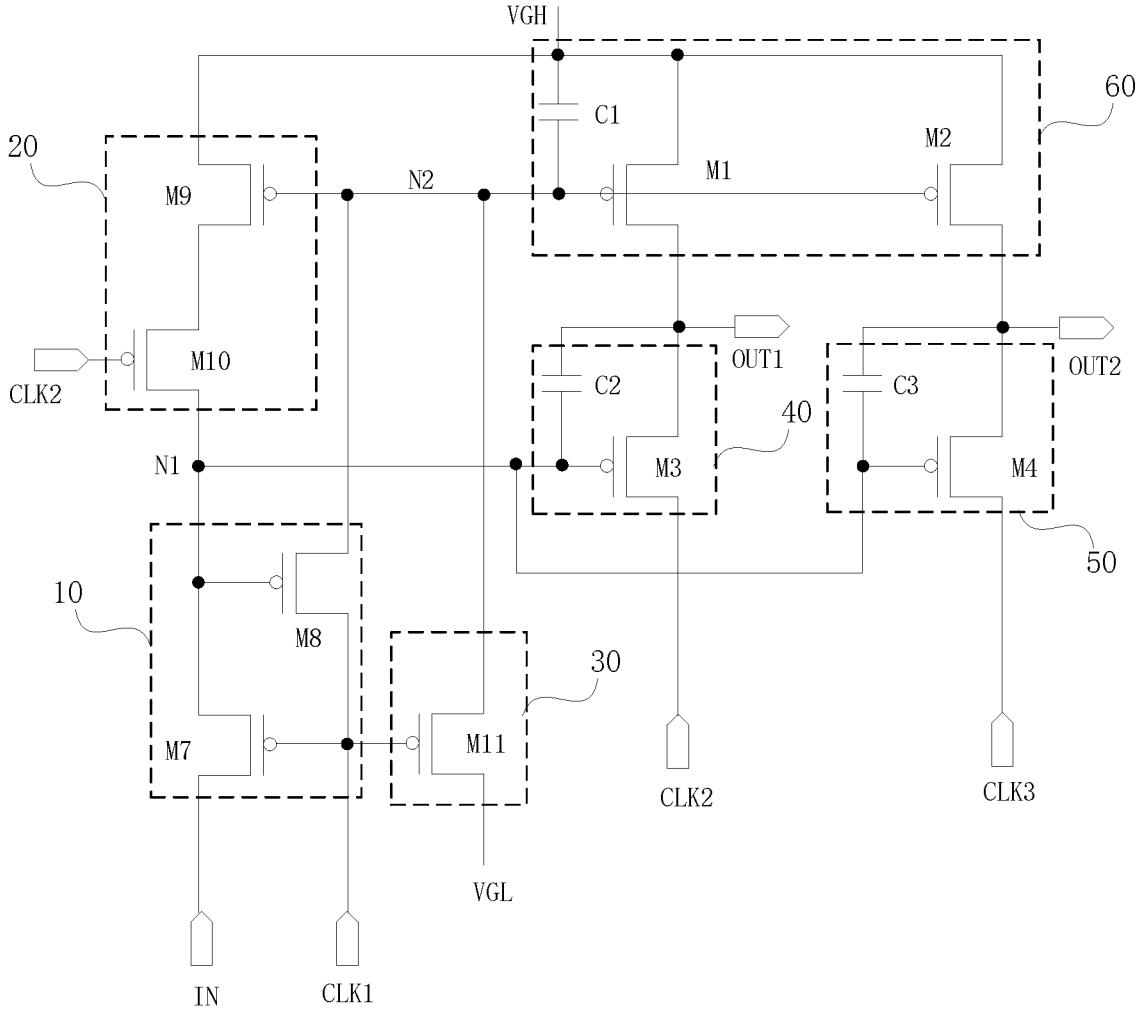
FIG. 5 is a schematic structural view of an exemplary shift register according to various embodiments of the present disclosure.

FIG. 5 is a schematic structural diagram of an exemplary shift register according to various embodiments of the present disclosure. In some embodiments of the present disclosure, as shown in FIG. 5, the stabilization module 60 includes a first transistor M1, a second transistor M2, and a first capacitor C1. The first output module 40 includes a third transistor M3 and a second capacitor C2. The second output module 50 includes a fourth transistor M4 and a third capacitor C3. The input module 10 includes a seventh transistor M7 and an eighth transistor M8. The control module 20 includes a ninth transistor M9 and a tenth transistor M10. The reset module 30 includes an eleventh transistor M11.

A first terminal of the first transistor M1 is electrically connected to the first voltage terminal VGH, a second terminal of the first transistor M1 is electrically connected to the first output terminal OUT1, and a control terminal of the first transistor M1 is electrically connected to the second node N2. A first terminal of the second transistor M2 is electrically connected to the first voltage terminal VGH, a second terminal of the second transistor M2 is electrically connected to the second output terminal OUT2, and a control terminal of the second transistor M2 is electrically connected to the second node N2. A first plate of the first capacitor C1 is electrically connected to the first voltage terminal VGH, and a second plate of the first capacitor C1 is electrically connected to the second node N2.

A first terminal of the third transistor M3 is electrically connected to the first output terminal OUT1, a second terminal of the third transistor M3 is electrically connected to the second clock signal terminal CLK2, and a control terminal of the third transistor M3 is electrically connected to the first node N1. A first plate of the second capacitor C2 is electrically connected to the first output terminal OUT1, and a second plate of the second capacitor C2 is electrically connected to the control terminal of the third transistor M3. A first terminal of the fourth transistor M4 is electrically connected to the second output terminal OUT2, a second terminal of the fourth transistor M4 is electrically connected to the third clock signal terminal CLK3, and a control terminal of the fourth transistor M4 is electrically connected to the first node N1. A first plate of the third capacitor C3 is electrically connected to the second output terminal OUT2, and a second plate of the third capacitor C3 is electrically connected to the control terminal of the fourth transistor M4.

A first terminal of the seventh transistor M7 is electrically connected to the signal input terminal IN, a second terminal of the seventh transistor M7 is electrically connected to the first node N1, and a control terminal of the seventh transistor M7 is electrically connected to the first clock signal terminal CLK1. A first terminal of the eighth transistor M8 is electrically connected to the first clock signal terminal CLK1, a second terminal of the eighth transistor M8 is electrically connected to the second node N2, and a control terminal of the eighth transistor M8 is electrically connected to the first node N1.

A first terminal of the ninth transistor M9 is electrically connected to the first voltage terminal VGH, and a control terminal of the ninth transistor M9 is electrically connected to the second node N2. A first terminal of the tenth transistor M10 is electrically connected to a second terminal of the ninth transistor M9, a second terminal of the tenth transistor M10 is electrically connected to the first node N1, and a control terminal of the tenth transistor M10 is electrically connected to the second clock signal terminal CLK2.

A first terminal of the eleventh transistor M11 is electrically connected to the second voltage terminal VGL, a second terminal of the eleventh transistor M11 is electrically connected to the second node N2, and a control terminal of the eleventh transistor M11 is electrically connected to the first clock signal terminal CLK1.

FIG. 5 only takes a circuit structure of a shift register as an example, and is not limited to this. In other embodiments, the shift register may also have other circuit structures, as long as it can realize functions of each module of the shift register.

In some embodiments of the present disclosure, as shown in FIG. 5, the first transistor M1, the second transistor M2, the third transistor M3, the fourth transistor M4, the seventh transistor M7, the eighth transistor M8, the ninth transistor M9, the tenth transistor M10, and the eleventh transistor M11 are all PMOS transistors. However, the present disclosure is not limited to this. In other embodiments, the first transistor M1, the second transistor M2, the third transistor M3, the four transistors M4, the seventh transistor M7, the eighth transistor M8, the ninth transistor M9, the tenth transistor M10, and the eleventh transistor M11 may all be NMOS transistors, or some of the transistors are NMOS transistors and some of the transistors are PMOS transistors.

When types of the transistors are different, for each module in the shift register to realize the above-mentioned function, waveforms or levels of signals that control the transistors need to be different. For example, a signal that controls a PMOS transistor to be turned on is a low level, a signal that controls a PMOS transistor to be turned off is a high level, a signal that controls an NMOS transistor to be turned on is a high level, and a signal that controls an NMOS transistor to be turned off is a low level.

Figure 6:
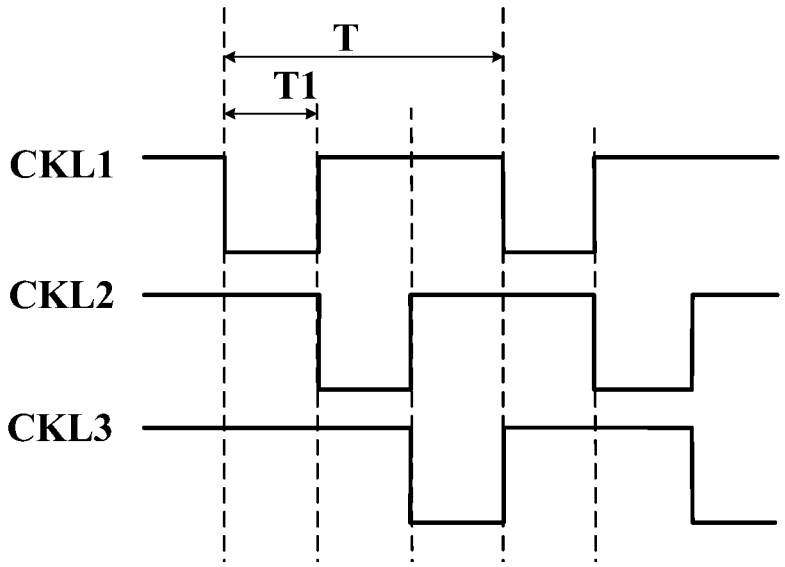
FIG. 6 is a signal timing diagram of a first clock signal terminal CLK1, a second clock signal terminal CLK2, and a third clock signal terminal CLK3 according to various embodiments of the present disclosure.

FIG. 6 is a signal timing diagram of a first clock signal terminal CLK1, a second clock signal terminal CLK2, and a third clock signal terminal CLK3 according to various embodiments of the present disclosure. In the embodiments of the present disclosure, as shown in FIG. 6, the first clock signal terminal CLK1 provides a first clock signal, the second clock signal terminal CLK2 provides a second clock signal, and the third clock signal terminal CLK3 provides a third clock signal. Pulses of the first clock signal, the second clock signal, and the third clock signal do not overlap with each other, and are arranged sequentially in time, so that the phase of the signal output from the second output terminal OUT2 lags behind the phase of the signal output from the first output terminal OUT1, and the phase of the signal output from the first output terminal OUT1 and the phase of the signal output from the second output terminal OUT2 do not overlap with each other. Optionally, a duty cycle of the first clock signal is greater than ¼, and less than or equal to ⅓. As shown in FIG. 6, the duty cycle of the first clock signal is a ratio of a low level time T1 over one cycle time T.

In some embodiments of the present disclosure, as shown in FIG. 5, when the first transistor M1, the second transistor M2, the third transistor M3, the fourth transistor M4, the seventh transistor M7, the eighth transistor M8, the ninth transistor M9, the tenth transistor M10, and the eleventh transistor M11 are PMOS transistors, the input module 10 responds to a low level of the first clock signal terminal CLK1 to provide a signal of the input signal terminal IN to the first node N1, the control module 20 responds to a low level of the second clock signal terminal CLK2 and a low level of the second node N2 to provide a first voltage VGH of the first voltage terminal VGH to the first node N1, and the reset module 30 responds to a low level of the first clock signal terminal CLK1 to provide a second voltage VGL of the second voltage terminal VGL to the second node N2. The first voltage VGH is greater than the second voltage $V_{GL}$, optionally, $6\ V \leq V_{GH} \leq 14\ V$, for example, $V_{GH}$ is 8 V, or $V_{GH}$ is 10 V; and $-14\ V \leq V_{GL} \leq -6\ V$, for example, $V_{GL}$ is −10 V, or $V_{GL}$ is −7 V. The first output module 40 responds to a first low level and a second low level of the first node N1 to provide the signal of the second clock signal terminal CLK2 to the first output terminal OUT1, and the second output module 50 responds at least to a third low level of the first node N1 to provide the signal of the third clock signal terminal CLK3 to the second output terminal OUT2, where the second low level is less than the first low level, and the third low level is less than the second low level.

The above process, that is, a working process of the shift register, will be described below in conjunction with a timing diagram of each node signal in the shift register and the structure of the shift register shown in FIG. 5.

Figure 7:
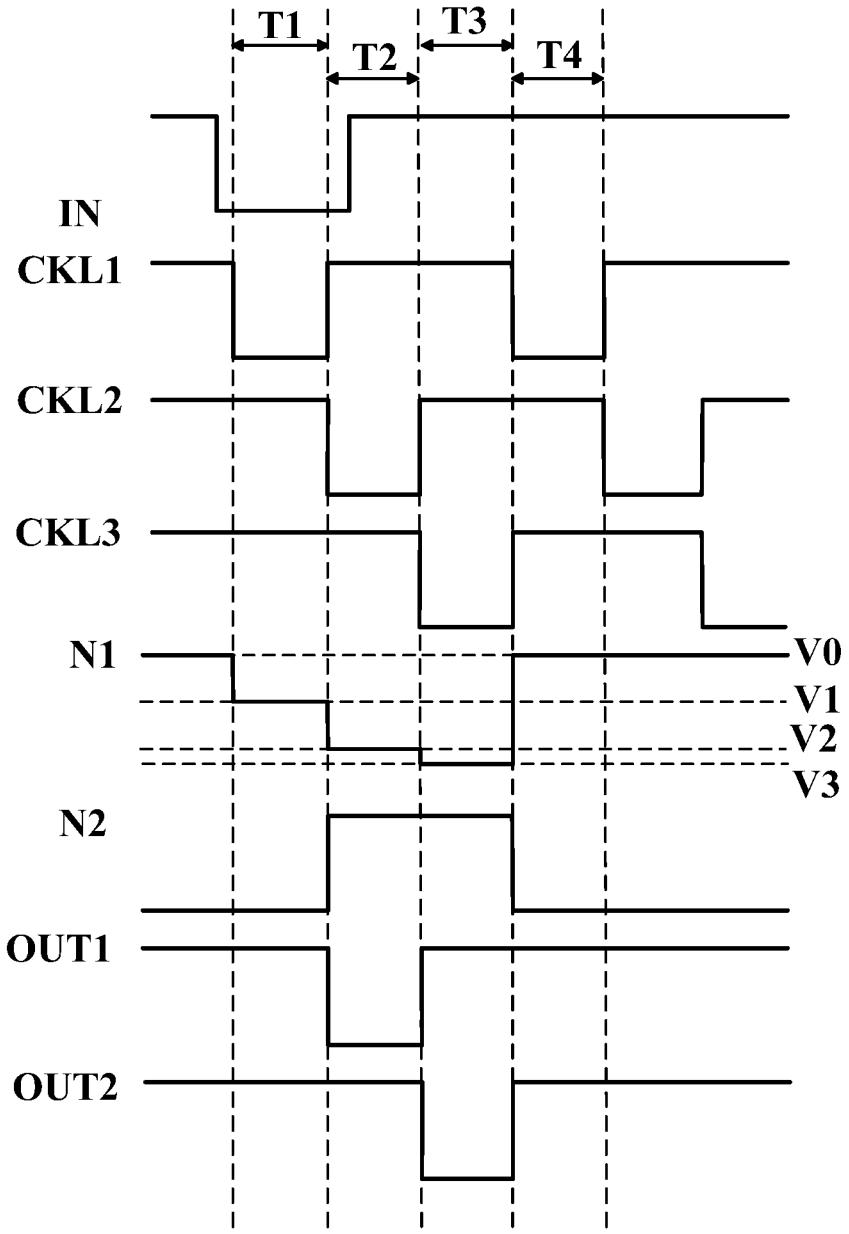
FIG. 7 is a signal timing diagram of each node in an exemplary shift register according to various embodiments of the present disclosure.
Figure 8:
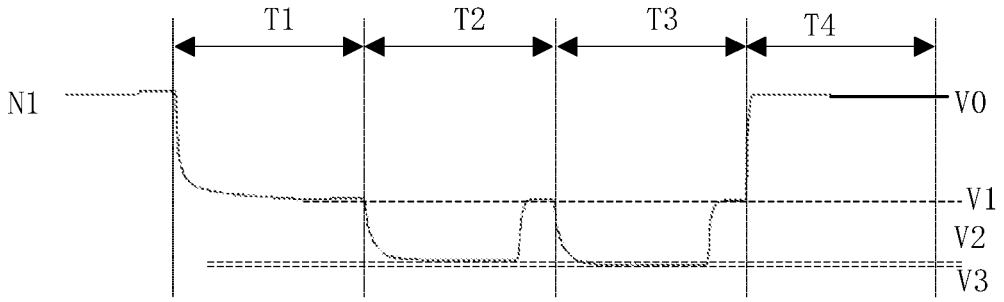
FIG. 8 is an enlarged view of a signal of a first node N1 according to various embodiments of the present disclosure.

FIG. 7 is a signal timing diagram of each node in an exemplary shift register according to various embodiments of the present disclosure, and FIG. 8 is an enlarged diagram of a signal of a first node N1 according to various embodiments of the present disclosure. As shown in FIG. 7 and FIG. 8, in a first stage T1, the signal input from the input signal terminal IN is a low level, and the first clock signal input from the first clock signal terminal CLK1 is a low level. The turned-on seventh transistor M7 provides the low level of the input signal terminal IN to the first node N1, so that the first node N1 is at a first low level V1, and the first low level V1 turns on the third transistor M3 and the fourth transistor M4. The turned-on third transistor M3 transmits the second clock signal of the second clock signal terminal CLK2, that is, a high level, to the first output terminal OUT1, so that the first output terminal OUT1 outputs a high level. The turned-on fourth transistor M4 transmits the third clock signal of the third clock signal terminal CLK3, that is, a high level, to the second output terminal OUT2, so that the second output terminal OUT2 outputs a high level. At a same time, the turned-on eleventh transistor M11 provides the second voltage to the second node N2, so that the second node N2 is at a low level, the turned-on first transistor M1 transmits the first voltage of the first voltage terminal VGH, that is, a high level, to the first output terminal OUT1, and the turned-on second transistor M2 transmits the first voltage of the first voltage terminal VGH, that is, a high level, to the second output terminal OUT2, thereby further ensuring stability of the high levels output from the first output terminal OUT1 and the second output terminal OUT2.

In a second stage T2, the signal input from the input signal terminal IN is a high level, the first clock signal input from the first clock signal terminal CLK1 is a high level, and the seventh transistor M7 and the eleventh transistor M11 are turned off. The turned-on eighth transistor M8 transmits the high level input from the first clock signal terminal CLK1 to the second node N2, so that the first transistor M1 and the second transistor M2 are turned off. Under bootstrapping of the second capacitor C2, the voltage of the first node N1 is pulled lower, so that the voltage of the first node N1 is a second low level V2, the second low level V2 is less than the first low level V1, and the second low level turns on the third transistor M3 and the fourth transistor M4. The turned-on third transistor M3 transmits the second clock signal of the second clock signal terminal CLK2, that is, a low level, to the first output terminal OUT1, so that the first output terminal OUT1 outputs a low level. The turned-on fourth transistor M4 transmits the third clock signal of the third clock signal terminal CLK3, that is, a high level, to the second output terminal OUT2, so that the second output terminal OUT2 outputs a high level.

In a third stage T3, the signal input from the input signal terminal IN is a high level, the first clock signal input from the first clock signal terminal CLK1 is a high level, and the seventh transistor M7 and the eleventh transistor M11 are continuously turned off. The turned-on eighth transistor M8 transmits the high level input from the first clock signal terminal CLK1 to the second node N2, so that the first transistor M1 and the second transistor M2 are turned off. Under bootstrapping of the third capacitor C3, the voltage of the first node N1 is pulled lower, so that the voltage of the first node N1 is a third low level V3, the third low level V3 is less than the second low level V2, and the third low level V3 turns on the third transistor M3 and the fourth transistor M4. The turned-on third transistor M3 transmits the second clock signal of the second clock signal terminal CLK2, that is, a high level, to the first output terminal OUT1, so that the first output terminal OUT1 outputs a high level. The turned-on fourth transistor M4 transmits the third clock signal of the third clock signal terminal CLK3, that is, a low level, to the second output terminal OUT2, so that the second output terminal OUT2 outputs a low level.

In a fourth stage T4, the signal input from the input signal terminal IN is a high level, the first clock signal input from the first clock signal terminal CLK1 is a low level, and the seventh transistor M7 and the eleventh transistor M11 are turned on. The turned-on seventh transistor M7 provides the high level of the input signal terminal IN to the first node N1, so that the first node N1 is at a high level V0, and V0 is greater than V1, so that the eighth transistor M8, the third transistor M3, and the fourth transistor M4 are turned off. The turned-on eleventh transistor M11 transmits the second voltage of the second voltage terminal VGL, that is, a low level, to the second node N2, so that the first transistor M1 and the second transistor M2 are turned on. The turned-on first transistor M1 transmits the first voltage of the first voltage terminal VGH to the first output terminal OUT1, and the turned-on second transistor M2 transmits the first voltage of the first voltage terminal VGH to the second output terminal OUT2, so that both the first output terminal OUT1 and the second output terminal OUT2 output high levels.

During operations of the shift register, when the input signal terminal IN inputs a trigger signal (such as a low level period from the input signal terminal IN in FIG. 5) and the signal input from the first clock signal terminal CLK1 is a low level, the shift register will perform the first stage T1 to the fourth stage T4, so that the first output terminal OUT1 and the second output terminal OUT2 output required signals.

In some embodiments of the present disclosure, to make a pulse width of the signal output from the first output terminal OUT1 equals to a pulse width of the signal output from the second output terminal OUT2, a capacitance of the second capacitor C2 and a capacitance of the third capacitor C3 are equal, and the third transistor M3 and the fourth transistor M4 have same aspect ratio and other parameters. In some optional embodiments, a capacitance range of the second capacitor C2 and the third capacitor C3 is from about 200 f to about 500 f, preferably about 200 f.

Figure 9:
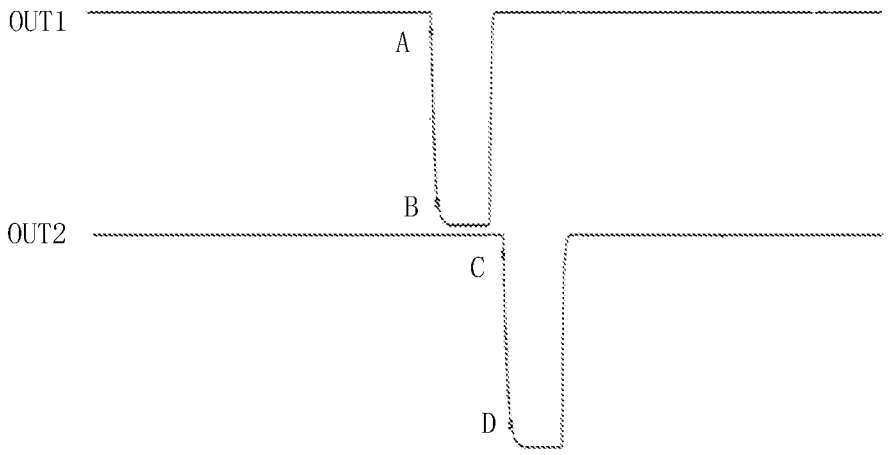
FIG. 9 is a signal timing diagram of a first output terminal OUT1 and a second output terminal OUT2 when a capacitance of a second capacitor C2 and a capacitance of a third capacitor C3 are equal according to various embodiments of the present disclosure.

However, in practical applications, after bootstrapping of the second capacitor C2 occurs in the second stage T2, compared to the voltage V1 of the first node N1 in the first stage T1, the voltage of the first node N1 in the second stage T2 is lower, and the voltage of the first node N1 is V2. Therefore, a leakage current will occur in the circuit, affecting the voltage of the first node N1, causing the voltage of the first node N1 to rise, thereby causing a delay of a falling edge of the signal output from the second output terminal OUT2 to be greater than a delay of a falling edge of the signal output from the first output terminal OUT1, when the third capacitor C3 is bootstrapped in the third stage T3. FIG. 9 is a signal timing diagram of a first output terminal OUT1 and a second output terminal OUT2 when a capacitance of a second capacitor C2 and a capacitance of a third capacitor C3 are equal according to various embodiments of the present disclosure. As shown in FIG. 9, a delay time of the falling edge of the signal output from the second output terminal OUT2 is 402 ns, that is, a falling time between point C and point D is 402 ns. A delay time of the falling edge of the signal output from the first output terminal OUT1 is 360 ns, that is, a falling time between point A and point B is 360 ns. The delay of the signal output from the output terminal OUT1 and the delay of the signal output from the second output terminal OUT2 are caused to be different.

Based on this, in some other embodiments of the present disclosure, the capacitance of the third capacitor C3 is greater than the capacitance of the second capacitor C2, so that when the third capacitor C3 is bootstrapped, the voltage of the first node N1 is the third low level V3, which is lower than the second low level V2, to reduce the difference between the delay of the falling edge of the signal output from the second output terminal OUT2 and the delay of the falling edge of the signal output from the first output terminal OUT1.

Figure 10:
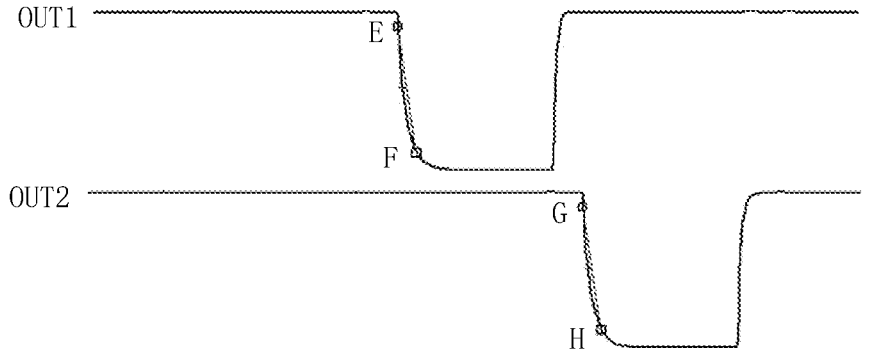
FIG. 10 is a signal timing diagram of a first output terminal OUT1 and a second output terminal OUT2 when a capacitance of a second capacitor C2 is smaller than a capacitance of a third capacitor C3 according to various embodiments of the present disclosure.

FIG. 10 is a signal timing diagram of a first output terminal OUT1 and a second output terminal OUT2 when a capacitance of a second capacitor C2 is smaller than a capacitance of a third capacitor C3 according to various embodiments of the present disclosure. As shown in FIG. 10, the delay time of the falling edge of the signal output from the second output terminal OUT2 is 380 ns, that is, a falling time between point G and point H is 380 ns. The delay time of the falling edge of the signal output from the first output terminal OUT1 is 381 ns, that is, a falling time between point E and point F is 381 ns. The delay of the falling edge of the signal output from the second output terminal OUT2 is substantially the same as the delay of the falling edge of the signal output from the first output terminal OUT1.

In some embodiments of the present disclosure, a ratio K of the capacitance of the third capacitor C3 over the capacitance of the second capacitor C2 ranges from about 1.01 to about 2. In other embodiments of the present disclosure, to further reduce the difference between the delay of the falling edge of the signal output from the second output terminal OUT2 and the delay of the falling edge of the signal output from the first output terminal OUT1, the ratio K of the capacitance of the third capacitor C3 over the capacitance of the second capacitor C2 ranges from about 1.1 to about 1.5, including endpoint values. In other embodiments of the present disclosure, to further reduce the difference between the delay of the falling edge of the signal output from the second output terminal OUT2 and the delay of the falling edge of the signal output from the first output terminal OUT1, the ratio K of the capacitance of the third capacitor C3 over the capacitance of the second capacitor C2 ranges from about 1.1 to about 1.2, including endpoint values. The delay of the falling edge of the signal output from the second output terminal OUT2 and the delay of the signal output from the first output terminal OUT1 are ensured to be similar or the same, and the difference between the signals output from the two output terminals is reduced.

On this basis, in some embodiments of the present disclosure, the capacitance of the second capacitor C2 is 200 f, and the capacitance of the third capacitor C3 ranges from about 202 f to about 400 f, including endpoint values. In other embodiments, the capacitance of the third capacitor C3 ranges from about 220 f to about 300 f, including endpoint values. In other embodiments, the capacitance of the third capacitor C3 ranges from about 220 f to about 240 f, including endpoint values.

A function of the first capacitor C1 is only to generate a sufficient voltage difference between the first voltage terminal VGH and the second node N2, while functions of the second capacitor C2 and the third capacitor C3 are to pull down voltages of gates of transistors through bootstrapping. Therefore, the capacitance of the second capacitor C2 and the third capacitor C3 can be set larger, that is, the capacitance of the second capacitor C2 and the third capacitor C3 can be greater than a capacitance of the first capacitor C1. In some optional embodiments, the capacitance of the first capacitor C1 is 100 f, and the capacitance of the second capacitor C2 and the third capacitor C3 is 200 f.

Figure 11:
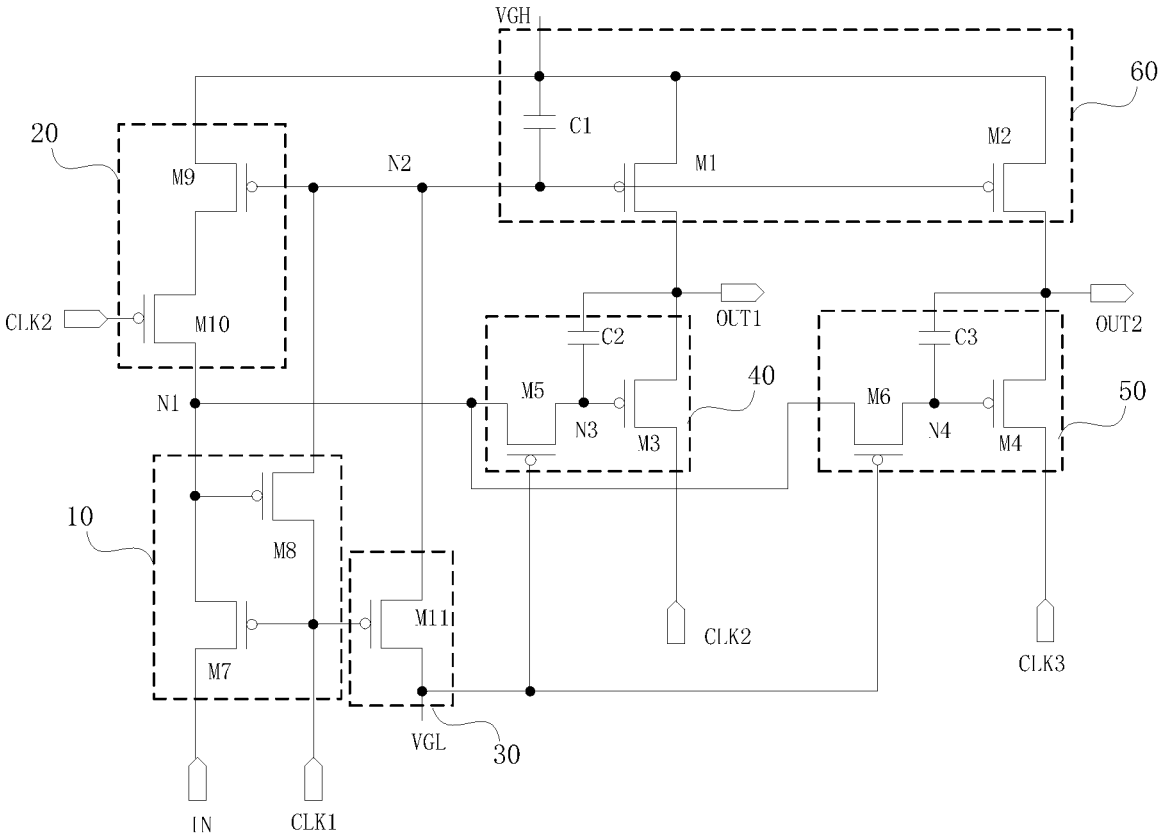
FIG. 11 is a schematic structural view of an exemplary shift register according to various embodiments of the present disclosure.

To further improve the influence of the leakage current on the voltage of the first node N1, and reduce the difference between the delay of the falling edge of the signal output from the second output terminal OUT2 and the delay of the falling edge of the signal output from the first output terminal OUT1, on the basis of the structure shown in FIG. 5, in other embodiments of the present disclosure, the first output module 40 further includes the fifth transistor M5, and the second output module 50 further includes the sixth transistor M6, as shown in FIG. 11, which is a schematic structural view of an exemplary shift register according to various embodiments of the present disclosure.

A first terminal of the fifth transistor M5 is electrically connected to the first node N1, a second terminal of the fifth transistor M5 is electrically connected to the control terminal of the third transistor M3, and a third node N3, and a control terminal of the fifth transistor M5 is electrically connected to the second voltage terminal VGL. A first terminal of the sixth transistor M6 is electrically connected to the first node N1, a second terminal of the sixth transistor M6 is electrically connected to the control terminal of the fourth transistor M4, and a fourth node N4, and a control terminal of the sixth transistor M6 is electrically connected to the second voltage terminal VGL.

In some embodiments of the present disclosure, the fifth transistor M5 and the sixth transistor M6 are both PMOS transistors. The present disclosure is not limited to this. In other embodiments, the fifth transistor M5 and the sixth transistor M6 may both be NMOS transistors, or, one is a PMOS transistor and the other is an NMOS transistor, which will not be repeated here.

Since the fifth transistor M5 and the sixth transistor M6 are turned on for a long time under control of a low level of the second voltage terminal VGL, voltages of the third node N3 and the fourth node N4 are substantially equal to the voltage of the first node N1. However, there is a certain resistance between a source and a drain of the turned-on fifth transistor M5 and sixth transistor M6. Therefore, even if the voltages of the third node N3 and the fourth node N4 are pulled down due to capacitor bootstrapping, it will not have much influence on the voltage of the first node N1. Since the voltage of the first node N1 is basically unaffected, the influence of the leakage current on the voltages of the third node N3 and the fourth node N4 will also be improved to a certain extent, thereby reducing the difference between the delay of the falling edge of the signal output from the first output terminal OUT1 and the delay of the falling edge of the signal output from the second output terminal OUT2.

Figure 12:
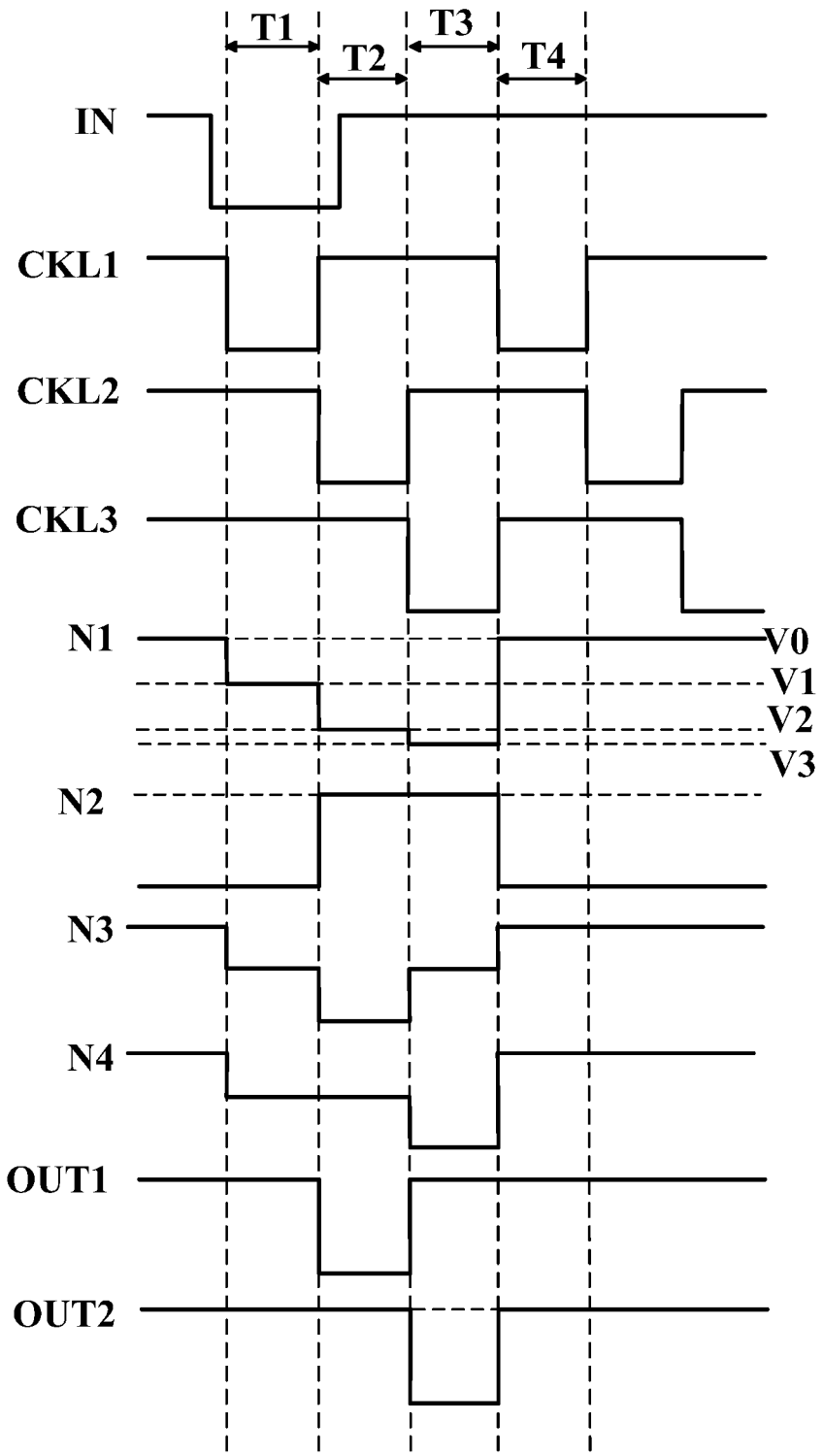
FIG. 12 is a signal timing diagram of each node in an exemplary shift register according to various embodiments of the present disclosure.

FIG. 12 is a signal timing diagram of each node in an exemplary shift register according to various embodiments of the present disclosure. A working process of the shift register with the structure shown in FIG. 11 is basically the same as that of the shift register with the structure shown in FIG. 5. However, as shown in FIG. 12, in the second stage T2, after the second capacitor C2 is bootstrapped, the voltage of the third node N3 is pulled lower, and the voltage of the third node N3 is lower than the voltage of the first node N1; and in the third stage T3, after the third capacitor C3 is bootstrapped, the voltage of the fourth node N4 is pulled lower, and the voltage of the fourth node N4 is lower than the voltage of the first node N1.

In some embodiments of the present disclosure, the fifth transistor M5 and the sixth transistor M6 are not designed to be differentiated, and the third transistor M3 and the fourth transistor M4 are not designed to be differentiated, that is, parameters such as the aspect ratio of the fifth transistor M5 and the sixth transistor M6 are the same, and parameters such as the aspect ratio of the third transistor M3 and the fourth transistor M4 are the same. Only through the difference in the capacitance of the second capacitor C2 and the third capacitor C3, the difference between the delay of the falling edge of the signal output from the second output terminal OUT2 and the delay of the falling edge of the signal output from the first output terminal OUT1 is reduced. However, the present disclosure is not limited to this. In other embodiments, the fifth transistor M5 and the sixth transistor M6 can also be designed differently, such as making the fifth transistor M5 and the sixth transistor M6 have different parameters such as the aspect ratio, to reduce the difference between the delay of the falling edge of the signal output from the second output terminal OUT2 and the delay of the falling edge of the signal output from the first output terminal OUT1. In other embodiments, the third transistor M3 and the fourth transistor M4 can also be designed differently. For example, the third transistor M3 and the fourth transistor M4 have different parameters such as the aspect ratio to reduce the difference between the delay of the falling edge of the output signal from the second output terminal OUT2 and the delay of the falling edge of the signal output from the first output terminal OUT1.

Figure 13:
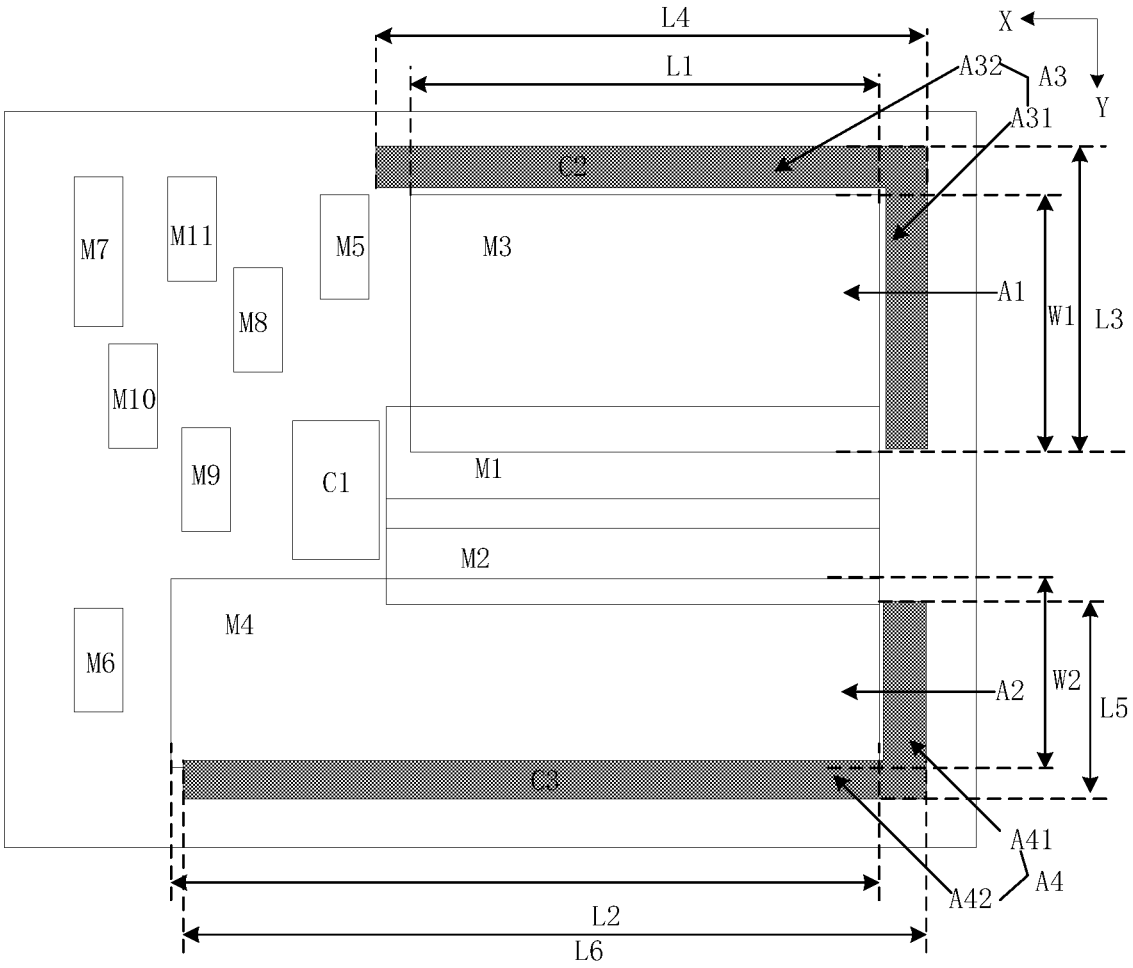
FIG. 13 is a schematic structural view of a layout of an exemplary shift register according to various embodiments of the present disclosure.

FIG. 13 is a schematic structural diagram of a layout of an exemplary shift register according to various embodiments of the present disclosure. In some embodiments of the present disclosure, as shown in FIG. 13, an area where the third transistor M3 is located is a first area A1, and an area where the fourth transistor M4 is located is a second area A2. The first area A1 and the second area A2 are arranged along a first direction Y. A size of the first area A1 in the first direction Y is W1, and a size in a second direction X is L1. A size of the second area in the first direction Y is W2, and a size in the second direction X is L2, where W1>W2 and L1<L2. The first direction Y intersects the second direction X.

An area where the second capacitor C2 is located is a third area A3, and an area where the third capacitor C3 is located is a fourth area A4. The third area A3 and the fourth area A4 are both L-shaped. The third area A3 includes a first sub-area A31 extending in the first direction Y and a second sub-area A32 extending in the second direction X. The fourth area includes a third sub-area A41 extending in the first direction Y and a fourth sub-area A42 extending in the second direction X. The third area A3 half-surrounds the first area A1, and the fourth area A4 half-surrounds the second area A2.

A size of the first sub-area A31 in the first direction Y is L3, and a size of the second sub-area A32 in the second direction X is L4. A size of the third sub-area A41 in the first direction Y is L5, and a size of the fourth sub-area A42 in the second direction X is L6, where $|L1-L2|>|W1-W2|$, $|L4-L6|>|L3-L5|$, so that the capacitance of the third capacitor C3 is greater than that of the second capacitor C2.

An area where a transistor is located in FIG. 13 refers to an area occupied by a gate, source, drain, and active layer of the transistor, and an overlapping portion between the areas where transistors are located refers to a portion between the transistors that are electrically connected to each other. Non-overlapping between areas where the transistors are does not mean that there is not a connection relationship between the transistors. The connection relationship can also be achieved through wiring between the areas. To avoid too many wires, no description is given on the wiring, etc.

Figure 14:
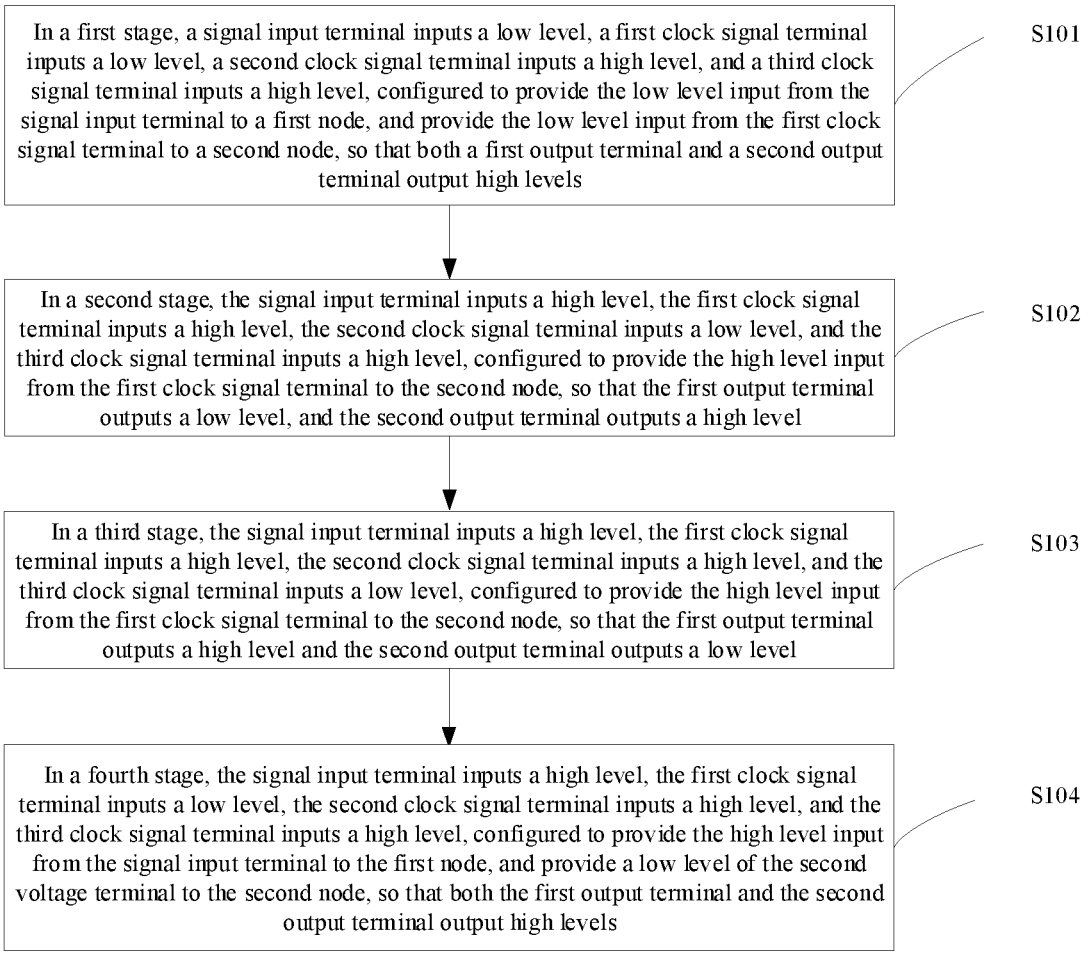
FIG. 14 is a flowchart of a driving method of an exemplary shift register according to various embodiments of the present disclosure.

The embodiments of the present disclosure also provide a driving method of a shift register, which is applied to the shift register provided in any of the above embodiments. FIG. 14 is a flowchart of a driving method of an exemplary shift register according to various embodiments of the present disclosure. As shown in FIG. 14, the driving method includes S101, S102, S103, and S104.

S101: in a first stage, a signal input terminal inputs a low level, a first clock signal terminal inputs a low level, a second clock signal terminal inputs a high level, and a third clock signal terminal inputs a high level, configured to provide the low level input from the signal input terminal to a first node, and provide the low level input from the first clock signal terminal to a second node, so that both a first output terminal and a second output terminal output high levels.

S102: in a second stage, the signal input terminal inputs a high level, the first clock signal terminal inputs a high level, the second clock signal terminal inputs a low level, and the third clock signal terminal inputs a high level, configured to provide the high level input from the first clock signal terminal to the second node, so that the first output terminal outputs a low level, and the second output terminal outputs a high level.

S103: in a third stage, the signal input terminal inputs a high level, the first clock signal terminal inputs a high level, the second clock signal terminal inputs a high level, and the third clock signal terminal inputs a low level, configured to provide the high level input from the first clock signal terminal to the second node, so that the first output terminal outputs a high level and the second output terminal outputs a low level.

S104: in a fourth stage, the signal input terminal inputs a high level, the first clock signal terminal inputs a low level, the second clock signal terminal inputs a high level, and the third clock signal terminal inputs a high level, configured to provide the high level input from the signal input terminal to the first node, and provide a low level of the second voltage terminal to the second node, so that both the first output terminal and the second output terminal output high levels.

Referring to FIG. 5 and FIG. 7, in the first stage T1, the signal input from the input signal terminal IN is a low level, the first clock signal input from the first clock signal terminal CLK1 is a low level, and the turned-on seventh transistor M7 provides the low level of the input signal terminal IN to the first node N1, so that the first node N1 is at the first low level V1, and the first low level V1 turns on the third transistor M3 and the fourth transistor M4. The turned-on third transistor M3 transmits the second clock signal of the second clock signal terminal CLK2, that is, a high level, to the first output terminal OUT1, so that the first output terminal OUT1 outputs a high level. The turned-on fourth transistor M4 transmits the third clock signal of the third clock signal terminal CLK3, that is, a high level, to the second output terminal OUT2, so that the second output terminal OUT2 outputs a high level. At a same time, the turned-on eleventh transistor M11 provides the second voltage to the second node N2, so that the second node N2 is at a low level, the turned-on first transistor M1 transmits the first voltage of the first voltage terminal VGH to the first output terminal OUT1, and the turned-on second transistor M2 transmits the first voltage of the first voltage terminal VGH, that is, a high level, to the second output terminal OUT2, thereby further ensuring the stability of the high levels output from the first output terminal OUT1 and the second output terminal OUT2.

In the second stage T2, the signal input from the input signal terminal IN is a high level, the first clock signal input from the first clock signal terminal CLK1 is a high level, and the seventh transistor M7 and the eleventh transistor M11 are turned off. The turned on eighth transistor M8 transmits the high level input from the first clock signal terminal CLK1 to the second node N2, so that the first transistor M1 and the second transistor M2 are turned off. Under bootstrapping of the second capacitor C2 and the third capacitor C3, the voltage of the first node N1 is pulled lower, so that the voltage of the first node N1 is the second low level V2, the second low level V2 is less than the first low level V1, and the second low level turns on the third transistor M3 and the fourth transistor M4. The turned-on third transistor M3 transmits the second clock signal of the second clock signal terminal CLK2, that is, a low level, to the first output terminal OUT1, so that the first output terminal OUT1 outputs a low level. The turned-on fourth transistor M4 transmits the third clock signal of the third clock signal terminal CLK3, that is, a high level, to the second output terminal OUT2, so that the second output terminal OUT2 outputs a high level.

In the third stage T3, the signal input from the input signal terminal IN is a high level, the first clock signal input from the first clock signal terminal CLK1 is a high level, and the seventh transistor M7 and the eleventh transistor M11 are continuously turned off. The turned-on eighth transistor M8 transmits the high level input from the first clock signal terminal CLK1 to the second node N2, so that the first transistor M1 and the second transistor M2 are turned off. Under bootstrapping of the second capacitor C2 and the third capacitor C3, the voltage of the first node N1 is pulled lower, so that the voltage of the first node N1 is the third low level V3, the third low level V3 is less than the second low level V2, and the third low level V3 turns on the third transistor M3 and the fourth transistor M4. The turned-on third transistor M3 transmits the second clock signal of the second clock signal terminal CLK2, that is, a high level, to the first output terminal OUT1, so that the first output terminal OUT1 outputs a high level. The turned-on fourth transistor M4 transmits the third clock signal of the third clock signal terminal CLK3, that is, a low level, to the second output terminal OUT2, so that the second output terminal OUT2 outputs a low level.

In the fourth stage T4, the signal input from the input signal terminal IN is a high level, the first clock signal input from the first clock signal terminal CLK1 is a low level, and the seventh transistor M7 and the eleventh transistor M11 are turned on. The turned on seventh transistor M7 provides the high level of the input signal terminal IN to the first node N1, so that the first node N1 is at the high level V0, and V0 is greater than V1, so that the eighth transistor M8, the third transistor M3, and the fourth transistor M4 are turned off. The turned-on eleventh transistor M11 transmits the second voltage of the second voltage terminal VGL, that is, a low level, to the second node N2, so that the first transistor M1 and the second transistor M2 are turned on. The turned-on first transistor M1 transmits the first voltage of the first voltage terminal VGH to the first output terminal OUT1, and the turned-on second transistor M2 transmits the first voltage of the first voltage terminal VGH, that is, a high level, to the second output terminal OUT2, so that both the first output terminal OUT1 and the second output terminal OUT2 output high levels.

The first output terminal OUT1 and the second output terminal OUT2 can respectively output two signals, and the phase of the signal output from the second output terminal OUT2 lags behind the phase of the signal output from the first output terminal OUT1, and does not overlap the phase of the signal output from the first output terminal OUT1. Therefore, the signals output from the first output terminal OUT1 and the second output terminal OUT2 can be electrically connected to two gate lines, respectively, to scan two rows of pixels respectively.

In addition, when the second node N2 is at a low level, the turned-on first transistor M1 transmits the first voltage of the first voltage terminal VGH, that is, a high level, to the first output terminal OUT1, and the turned-on second transistor M2 transmits the first voltage of the first voltage terminal VGH, that is, a high level, to the second output terminal OUT2, thereby further ensuring the stability of the high levels output from the first output terminal OUT1 and the second output terminal OUT2.

Figure 15:
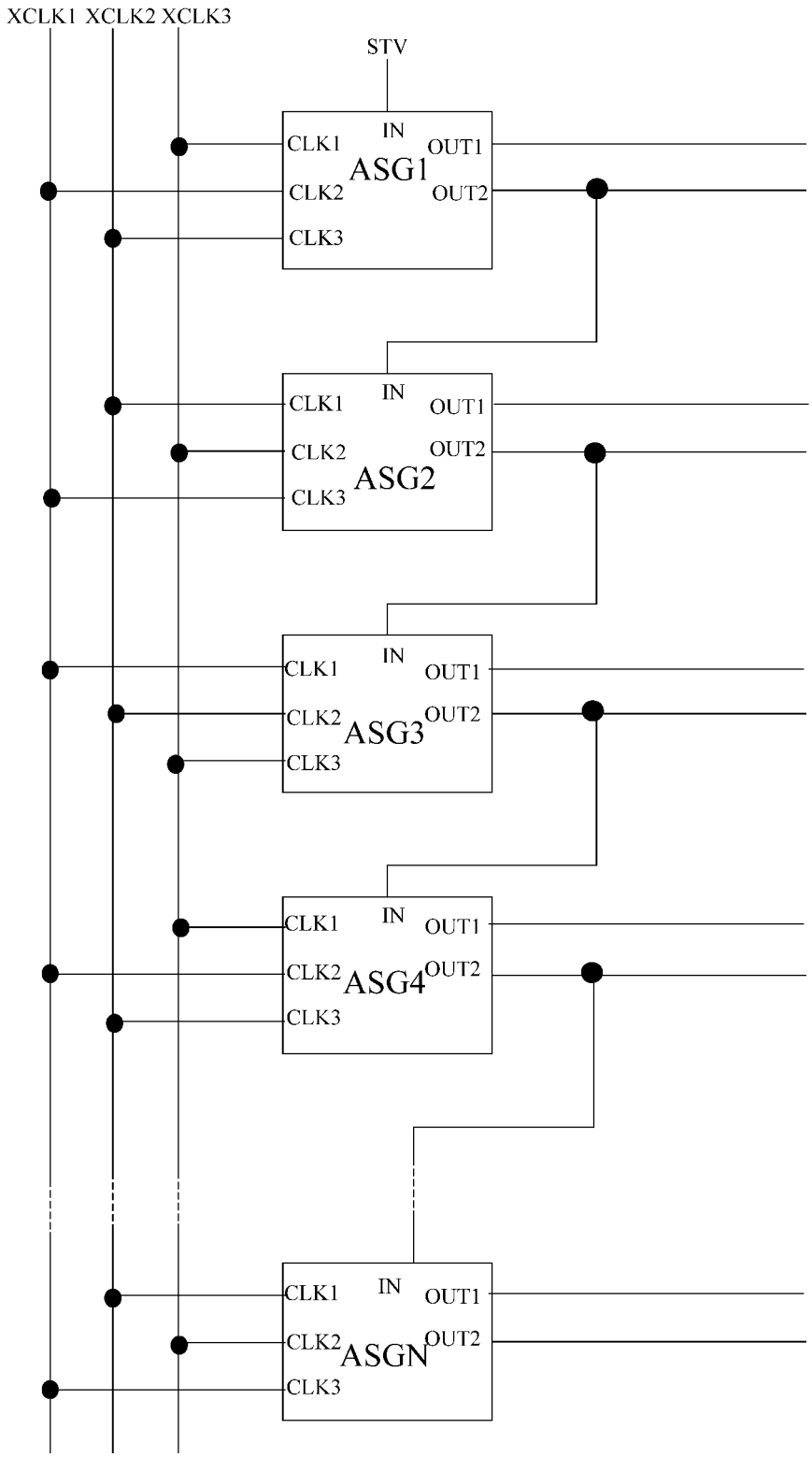
FIG. 15 is a schematic structural view of an exemplary scan driving circuit according to various embodiments of the present disclosure.

The embodiments of the present disclosure also provide a scan driving circuit. FIG. 15 is a schematic structural diagram of an exemplary scan driving circuit according to various embodiments of the present disclosure. As shown in FIG. 15, the scan driving circuit includes shift registers ASG1 to ASGN (N≥2) arranged in multiple cascaded stages, an initial signal line STV, a first clock signal line XCLK1, a second clock signal line XCLK2, and a third clock signal line XCLK3, where the shift registers are the shift register provided by any of the above embodiments.

In some embodiments of the present disclosure, as shown in FIG. 15, the signal input terminal IN of a first-stage shift register ASG1 is electrically connected to the initial signal line STV, and the initial signal line STV is configured to input a signal to the signal input terminal IN. Except for the first-stage shift register ASG1, the signal input terminal IN of each stage shift register is electrically connected to the second output terminal OUT2 of a previous stage shift register to use a signal output from the second output terminal OUT2 of the previous stage shift register as a signal of the signal input terminal IN of a next stage shift register, so that the cascaded shift registers ASG1 to ASGN sequentially output signals.

For a 3n-th-stage shift register, a first clock signal terminal CLK1 thereof is electrically connected to the first clock signal line XCLK1, a second clock signal terminal CLK2 thereof is electrically connected to the second clock signal line XCLK2, and a third clock signal terminal CLK3 thereof is electrically connected to the third clock signal line XCLK3. For a 3n+1st-stage shift register, a first clock signal terminal CLK1 thereof is electrically connected to the third clock signal line XCLK3, a second clock signal terminal CLK2 thereof is electrically connected to the first clock signal line XCLK1, and a third clock signal terminal CLK3 thereof is electrically connected to the second clock signal line XCLK2. For a 3n+2nd stage shift register, a first clock signal terminal CLK1 thereof is electrically connected to the second clock signal line XCLK2, a second clock signal terminal CLK2 thereof is electrically connected to the third clock signal line XCLK3, and a third clock signal terminal CLK3 thereof is electrically connected to the first clock signal line XCLK1. The n is 0 or a positive integer.

As shown in FIG. 15, when n is equal to 0, for the first-stage shift register ASG1, a first clock signal terminal CLK1 thereof is electrically connected to the third clock signal line XCLK3, a second clock signal terminal CLK2 thereof is electrically connected to the first clock signal line XCLK1, and a third clock signal terminal CLK3 thereof is electrically connected to the second clock signal line XCLK2. For a second-stage shift register ASG2, a first clock signal terminal CLK1 thereof is electrically connected to the second clock signal line XCLK2, a second clock signal terminal CLK2 thereof is electrically connected to the third clock signal line XCLK3, and a third clock signal terminal CLK3 thereof is electrically connected to the first clock signal line XCLK1. When n is equal to 1, for a third-stage shift register ASG3, a first clock signal terminal CLK1 thereof is electrically connected to the first clock signal line XCLK1, a second clock signal terminal CLK2 thereof is electrically connected to the second clock signal line XCLK2, and a third clock signal terminal CLK3 thereof is electrically connected to the third clock signal line XCLK3. Other shift registers can be deduced by analogy, which will not be repeated here.

Figure 16:
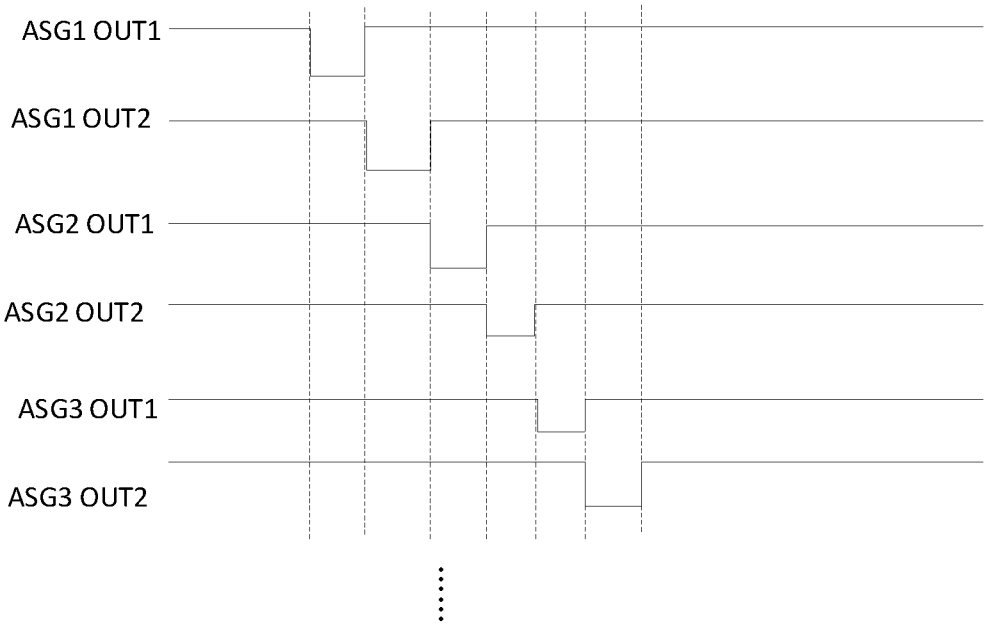
FIG. 16 is a timing diagram of signals output from each output terminal of cascaded shift registers shown in FIG. 15.

FIG. 16 is a timing diagram of signals output from each output terminal of cascaded shift registers shown in FIG. 15. As shown in FIG. 16, not only the phases of the signals output from the first output terminal OUT1 and the second output terminal OUT2 of a same shift register do not overlap with each other, but also the phases of the signals output from the first output terminal OUT1 and the second output terminal OUT2 of different shift registers do not overlap with each other. Based on this, the signals output from the output terminals of the cascaded shift registers can be connected to multiple gate lines in a display panel, respectively, to provide scan signals to multiple rows of pixels in the display panel.

Figure 17:
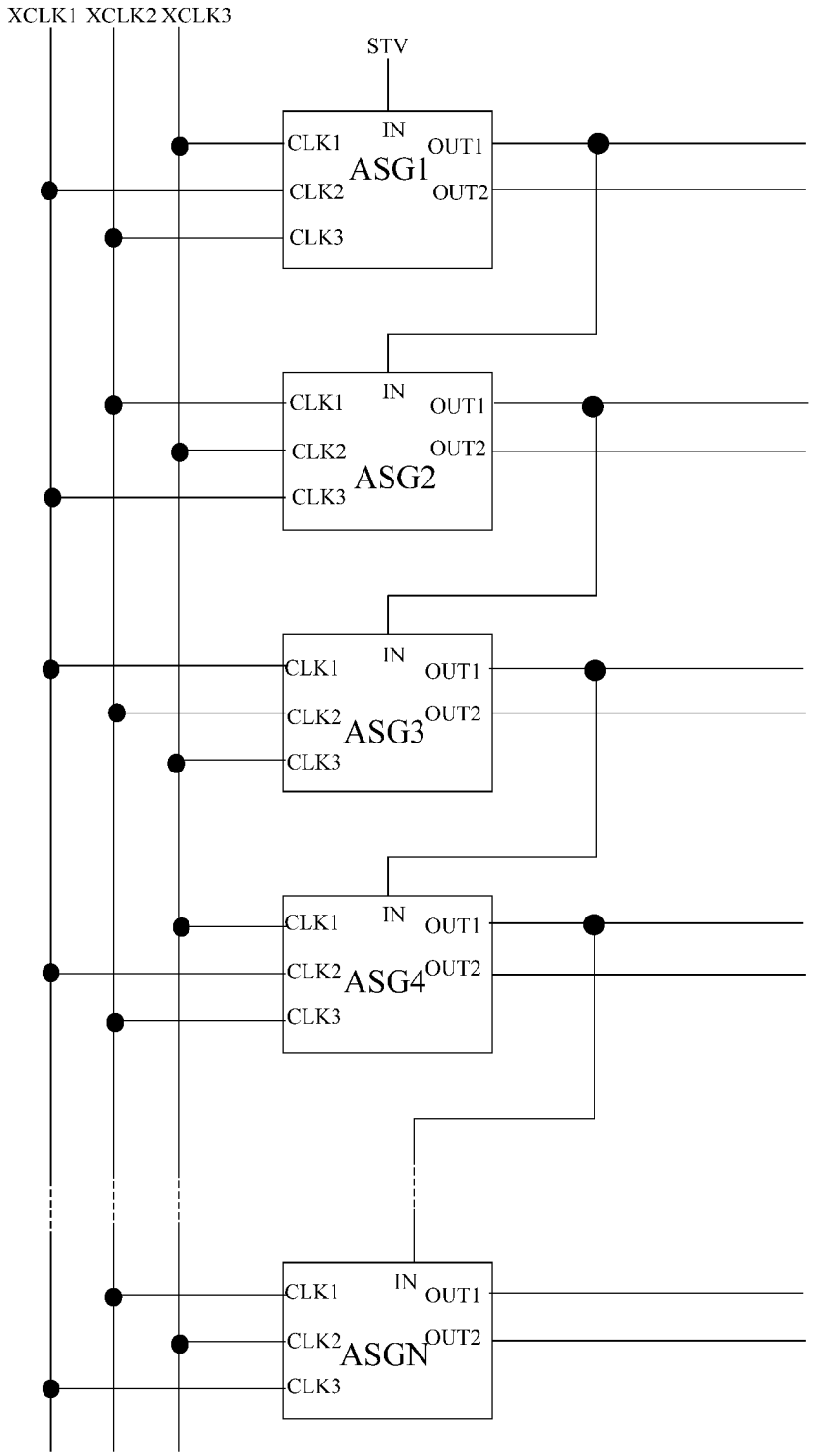
FIG. 17 is a schematic structural view of an exemplary scan driving circuit according to various embodiments of the present disclosure.

The present disclosure is not limited to this. FIG. 17 is a schematic structural view of an exemplary scan driving circuit according to various embodiments of the present disclosure. In other embodiments, as shown in FIG. 17, the signal input terminal IN of the first-stage shift register ASG1 is electrically connected to the initial signal line STV, and the initial signal line STV is configured to input a signal to the signal input terminal IN. Except for the first-stage shift register ASG1, the signal input terminal IN of each stage shift register is electrically connected to the first output terminal OUT1 of the previous stage shift register to use a signal output from the first output terminal OUT1 of the previous stage shift register as a signal of the signal input terminal IN of the next stage shift register.

Figure 18:
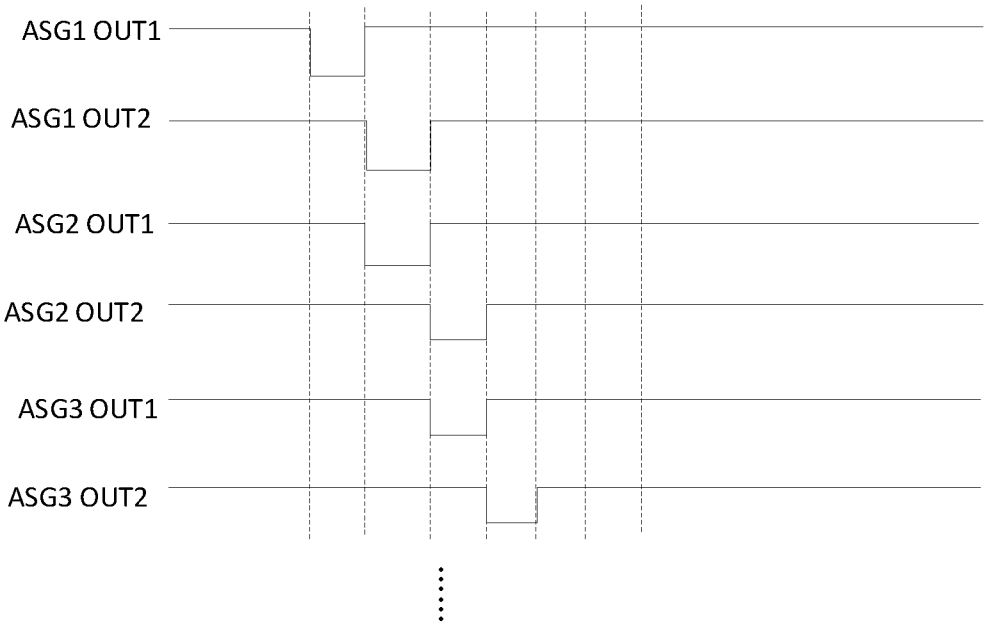
FIG. 18 is a timing diagram of signals output from each output terminal of cascaded shift registers shown in FIG. 17.

FIG. 18 is a timing diagram of signals output from each output terminal of cascaded shift registers shown in FIG. 17. As shown in FIG. 18, the phases of the signals output from the first output terminal OUT1 and the second output terminal OUT2 of a same shift register do not overlap with each other. However, the phases of the signal output from the first output terminal OUT1 of the next stage shift register and the signal output from the second output terminal OUT2 of the previous stage shift register overlap with each other. Based on this, the signals output from the first output terminal OUT1 and the second output terminal OUT2 of a same shift register can be provided to pixel driving circuits of a same row of pixels, as the signals of the S1 and S2 input terminals in the pixel driving circuits, respectively.

Based on the above, in the embodiments of the present disclosure, pulses of the first clock signal line XCLK1, the second clock signal line XCLK2, and the third clock signal line XCLK3, do not overlap with each other, and are arranged sequentially in time, so that pulse signals of the first clock signal terminal CLK1, the second clock signal terminal CLK2, and the third clock signal terminal CLK3, do not overlap with each other, and are arranged sequentially in time.

Figure 19:
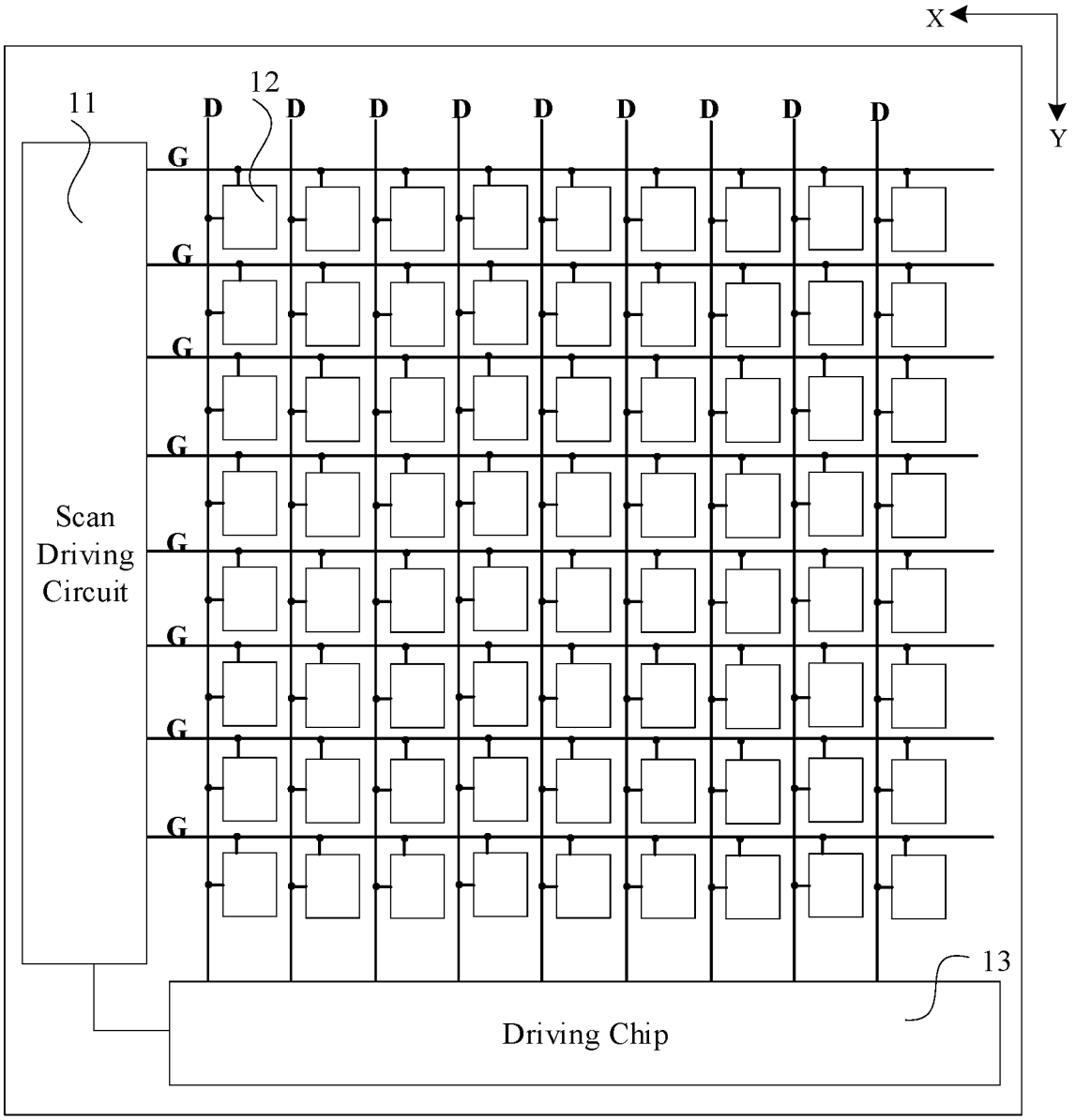
FIG. 19 is a schematic structural top view of an exemplary display panel according to various embodiments of the present disclosure.

The embodiments of the present disclosure also provide a display panel. FIG. 19 is a schematic diagram of a top view structure of an exemplary display panel according to various embodiments of the present disclosure. As shown in FIG. 19, the display panel includes a scan driving circuit 11 provided in the above embodiments, a plurality of scan signal lines G, and a plurality of pixel driving circuits 12. As shown in FIG. 19, the display panel provided by the embodiments of the present disclosure further includes a plurality of data lines D and driving chips 13, which are not described here.

In some embodiments of the present disclosure, the first output terminal OUT1 and the second output terminal OUT2 of shift registers of the scan driving circuit 11 are electrically connected to the plurality of scan signal lines G. The plurality of scan signal lines G is electrically connected to the plurality of pixel driving circuits 12. Optionally, the first output terminal OUT1 and the second output terminal OUT2 of a same shift register are respectively electrically connected to two adjacent scan signal lines G, so as to drive pixel driving circuits 12 in two adjacent rows of pixels.

The display panel in the embodiments of the present disclosure may be a liquid crystal display panel, an OLED display panel, and the like. When the display panel is the liquid crystal display panel, a pixel driving circuit 12 includes a transistor, and controls whether a pixel emits light to display an image through the transistor. When the display panel is the OLED display panel, as shown in FIG. 3, the pixel driving circuit 12 includes at least two connected transistors and one capacitor, and controls a pixel to emit light to display an image through the at least two transistors and one capacitor.

In the embodiments of the present disclosure, only the first output terminal OUT1 and the second output terminal OUT2 of a same shift register are electrically connected to two adjacent scan signal lines G as an example. However, the present disclosure is not limited to this. In other embodiments, the first output terminal OUT1 and the second output terminal OUT2 of a same shift register may also be electrically connected to two non-adjacent scan signal lines G, such as the first output terminal OUT1 of a first shift register is electrically connected to a first scan signal line G, the second output terminal OUT2 is electrically connected to a third scan signal line G, the first output terminal OUT1 of a second shift register is electrically connected to a second scan signal line G, and the second output terminal OUT2 is electrically connected to a fourth scan signal line G, where the first scan signal line G and the second scan signal line G provide scan signals to pixel driving circuits 12 of pixels in a same row, and the third scan signal line G and the fourth scan signal line G provide scan signals to pixel driving circuits 12 of pixels in a same row.

In the embodiments of the present disclosure, only one side of the display panel has a scan driving circuit as an example for description. The present disclosure is not limited to this. In other embodiments, opposite sides of the display panel may have scan driving circuits, which will not be repeated here.

Figure 20:
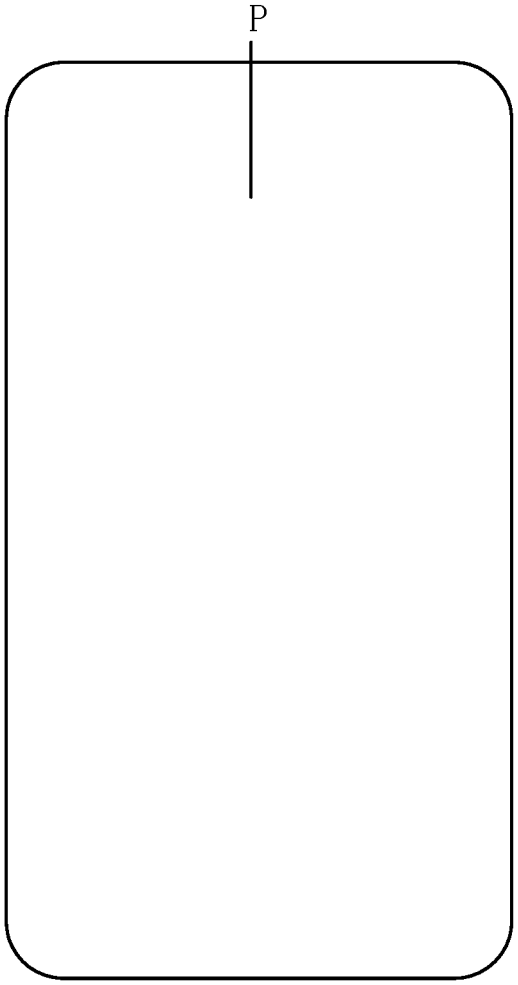
FIG. 20 is a schematic structural view of an exemplary display device according to various embodiments of the present disclosure.

The embodiments of the present disclosure also provide a display device including the display panel provided in the above embodiments. FIG. 20 is a schematic structural diagram of an exemplary display device according to various embodiments of the present disclosure. As shown in FIG. 20, a display device P includes, but is not limited to, a full-screen mobile phone, a tablet computer, and a digital camera. Moreover, the display device P may be a liquid crystal display device, an LED display device, an OLED display device, a flexible display device, and the like.

Compared with the prior art, the technical solutions provided by the present disclosure have the following advantages.

In the shift register and the driving method thereof, the scan driving circuit, the display panel, and the display device, provided by the present disclosure, the first output module and the second output module can respectively output two outputs under action of the same input module, control module, and reset module. The phase of the signal output from the second output module lags behind the phase of the signal output from the first output module, and does not overlap with the phase of the signal output from the first output module. Therefore, the signals output from the first output module and the second output module can be respectively electrically connected to two gate lines to respectively scan two rows of pixels.

Compared with the solution of scanning two rows of pixels through two shift registers in the prior art, the solutions of scanning two rows of pixels through one shift register in the present disclosure greatly reduce the layout area of the scan driving circuit. Therefore, the layout space occupation ratio of the scan driving circuit is reduced, so that the non-display area in the display panel can be further reduced, which is more conducive to the realization of a full screen.

In addition, the stabilization module of the present disclosure provides the voltage of the first voltage terminal to the first output terminal and the second output terminal respectively in response to the voltage of the second node, thereby ensuring stable output of the first output terminal and the second output terminal.

The various embodiments in this specification are described in a progressive manner. Each embodiment focuses on differences from other embodiments, and same or similar parts between the various embodiments can be referred to each other. For the device disclosed in the embodiments, since it corresponds to the method disclosed in the embodiments, the description is relatively simple, and relevant parts can be referred to the description of the method.

The foregoing description of the disclosed embodiments enables those skilled in the art to implement or use the present disclosure. Various modifications to these embodiments will be obvious to those skilled in the art, and general principles defined in this document can be implemented in other embodiments without departing from the spirit or scope of the present disclosure. Therefore, the present disclosure will not be limited to the embodiments shown in this document, but should conform to a widest scope consistent with the principles and novel features disclosed in this document.

What is claimed is:

1. A shift register, comprising:

an input module, electrically connected to a signal input terminal and a first clock signal terminal, and configured to provide a signal of the signal input terminal to a first node in response to a signal of the first clock signal terminal;

a control module, electrically connected to a first voltage terminal, a second clock signal terminal, and a second node, and configured to provide a voltage of the first voltage terminal to the first node in response to a voltage of the second node and a signal of the second clock signal terminal;

a reset module, electrically connected to a second voltage terminal and the first clock signal terminal, and configured to provide a voltage of the second voltage terminal to the second node in response to the signal of the first clock signal terminal;

a first output module, electrically connected to the first node and the second clock signal terminal, and configured to provide the signal of the second clock signal terminal to a first output terminal in response to a voltage of the first node;

a second output module, electrically connected to the first node and a third clock signal terminal, and configured to provide a signal of the third clock signal terminal to a second output terminal in response to the voltage of the first node; and a stabilization module, electrically connected to the second node and the first voltage terminal, and configured to provide the voltage of the first voltage terminal to the first output terminal and the second output terminal respectively in response to the voltage of the second node, wherein:

a phase of a signal output from the second output module lags behind a phase of a signal output from the first output module, and does not overlap with the phase of the signal output from the first output module, and the stabilization module includes:

a first transistor, wherein a first terminal of the first transistor is electrically connected to the first voltage terminal, a second terminal of the first transistor is electrically connected to the first output terminal, and a control terminal of the first transistor is electrically connected to the second node;

a second transistor, wherein a first terminal of the second transistor is electrically connected to the first voltage terminal, a second terminal of the second transistor is electrically connected to the second output terminal, and a control terminal of the second transistor is electrically connected to the second node; and a first capacitor, wherein a first plate of the first capacitor is electrically connected to the first voltage terminal, and a second plate of the first capacitor is electrically connected to the second node, the first output module includes:

a third transistor, wherein a first terminal of the third transistor is electrically connected to the first output terminal, and a second terminal of the third transistor is electrically connected to the second clock signal terminal; and a second capacitor, wherein a first plate of the second capacitor is electrically connected to the first output terminal, and a second plate of the second capacitor is electrically connected to a control terminal of the third transistor; and the second output module includes:

a fourth transistor, wherein a first terminal of the fourth transistor is electrically connected to the second output terminal, and a second terminal of the fourth transistor is electrically connected to the third clock signal terminal; and a third capacitor, wherein a first plate of the third capacitor is electrically connected to the second output terminal, and a second plate of the third capacitor is electrically connected to a control terminal of the fourth transistor, and a capacitance of the third capacitor is greater than a capacitance of the second capacitor.

2. The shift register according to claim 1, wherein:

a pulse width of the signal output from the second output module is equal to a pulse width of the signal output from the first output module.

3. The shift register according to claim 1, wherein:

$1.1<K<1.5$, wherein K is a ratio of the capacitance of the third capacitor over the capacitance of the second capacitor.

4. The shift register according to claim 1, wherein:

the first output module further includes a fifth transistor, wherein a first terminal of the fifth transistor is electrically connected to the first node, a second terminal of the fifth transistor is electrically connected to the control terminal of the third transistor, and a control terminal of the fifth transistor is electrically connected to the second voltage terminal; and the second output module further includes a sixth transistor, wherein a first terminal of the sixth transistor is electrically connected to the first node, a second terminal of the sixth transistor is electrically connected to the control terminal of the fourth transistor, and a control terminal of the sixth transistor is electrically connected to the second voltage terminal.

5. The shift register according to claim 1, wherein:

an area where the third transistor is located is a first area, an area where the fourth transistor is located is a second area, the first area and the second area are arranged along a first direction, a size of the first area in the first direction is W1, a size of the first area in a second direction is L1, a size of the second area in the first direction is W2, and a size of the second area in the second direction is L2, wherein W1>W2, L1<L2; and the first direction intersects the second direction.

6. The shift register according to claim 5, wherein:

an area where the second capacitor is located is a third area, an area where the third capacitor is located is a fourth area, the third area and the fourth area are both L-shaped, the third area includes a first sub-area extending along the first direction and a second sub-area extending along the second direction, the fourth area includes a third sub-area extending in the first direction and a fourth sub-area extending in the second direction, the third area half-surrounds the first area, and the fourth area half-surrounds the second area.

7. The shift register according to claim 6, wherein:

a size of the first sub-area in the first direction is L3, a size of the second sub-area in the second direction is L4, a size of the third sub-area in the first direction is L5, and a size of the fourth sub-area in the second direction is L6, wherein |L1−L2|>|W1−W2|, |L4−L6|>|L3−L5|.

8. The shift register according to claim 1, wherein:

the first clock signal terminal provides a first clock signal, the second clock signal terminal provides a second clock signal, and the third clock signal terminal provides a third clock signal; and pulses of the first clock signal, the second clock signal, and the third clock signal do not overlap with each other, and are arranged sequentially in time.

9. The shift register according to claim 8, wherein:

a duty cycle of the first clock signal is greater than ¼ and less than or equal to ⅓.

10. The shift register according to claim 1, wherein:

the input module includes:

a seventh transistor, wherein a first terminal of the seventh transistor is electrically connected to the signal input terminal, a second terminal of the seventh transistor is electrically connected to the first node, and a control terminal of the seventh transistor is electrically connected to the first clock signal terminal; and an eighth transistor, wherein a first terminal of the eighth transistor is electrically connected to the first clock signal terminal, a second terminal of the eighth transistor is electrically connected to the second node, and a control terminal of the eighth transistor is electrically connected to the first node;

the control module includes:

a ninth transistor, wherein a first terminal of the ninth transistor is electrically connected to the first voltage terminal, and a control terminal of the ninth transistor is electrically connected to the second node; and a tenth transistor, wherein a first terminal of the tenth transistor is electrically connected to a second terminal of the ninth transistor, a second terminal of the tenth transistor is electrically connected to the first node, and a control terminal of the tenth transistor is electrically connected to the second clock signal terminal; and the reset module includes:

an eleventh transistor, wherein a first terminal of the eleventh transistor is electrically connected to the second voltage terminal, a second terminal of the eleventh transistor is electrically connected to the second node, and a control terminal of the eleventh transistor is electrically connected to the first clock signal terminal.

11. The shift register according to claim 1, wherein:

the input module provides a signal of the input signal terminal to the first node in response to a low level of the first clock signal terminal;

the control module provides a first voltage of the first voltage terminal to the first node in response to a low level of the second clock signal terminal and a low level of the second node;

the reset module provides a second voltage of the second voltage terminal to the second node in response to a low level of the first clock signal terminal; and the first voltage is greater than the second voltage.

12. The shift register according to claim 11, wherein:

the first output module provides a signal of the second clock signal terminal to the first output terminal in response to a first low level and a second low level of the first node; and the second output module provides a signal of the third clock signal terminal to the second output terminal at least in response to a third low level of the first node, wherein:

the second low level is less than the first low level, and the third low level is less than the second low level.

13. A driving method of the shift register according to claim 1, comprising:

in a first stage, the signal input terminal inputs a low level, the first clock signal terminal inputs a low level, the second clock signal terminal inputs a high level, and the third clock signal terminal inputs a high level, configured to provide the low level input from the signal input terminal to the first node, and provide the low level input from the first clock signal terminal to the second node, so that the first output terminal and the second output terminal both output high levels;

in a second stage, the signal input terminal inputs a high level, the first clock signal terminal inputs a high level, the second clock signal terminal inputs a low level, and the third clock signal terminal inputs a high level, configured to provide the high level input from the first clock signal terminal to the second node, so that the first output terminal outputs a low level, and the second output terminal outputs a high level;

in a third stage, the signal input terminal inputs a high level, the first clock signal terminal inputs a high level, the second clock signal terminal inputs a high level, and the third clock signal terminal inputs a low level, configured to provide the high level input from the first clock signal terminal to the second node, so that the first output terminal outputs a high level, and the second output terminal outputs a low level; and in a fourth stage, the signal input terminal inputs a high level, the first clock signal terminal inputs a low level, the second clock signal terminal inputs a high level, and the third clock signal terminal inputs a high level, configured to provide the high level input from the input signal terminal to the first node, and provide a low level of the second voltage terminal to the second node, so that the first output terminal and the second output terminal both output high levels.

14. A scan driving circuit, comprising:

shift registers, arranged in a cascaded manner, wherein each of the shift registers includes:

an input module, electrically connected to a signal input terminal and a first clock signal terminal, and configured to provide a signal of the signal input terminal to a first node in response to a signal of the first clock signal terminal;

a control module, electrically connected to a first voltage terminal, a second clock signal terminal, and a second node, and configured to provide a voltage of the first voltage terminal to the first node in response to a voltage of the second node and a signal of the second clock signal terminal;

a reset module, electrically connected to a second voltage terminal and the first clock signal terminal, and configured to provide a voltage of the second voltage terminal to the second node in response to the signal of the first clock signal terminal;

a first output module, electrically connected to the first node and the second clock signal terminal, and configured to provide the signal of the second clock signal terminal to a first output terminal in response to the voltage of the first node;

a second output module, electrically connected to the first node and a third clock signal terminal, and configured to provide a signal of the third clock signal terminal to a second output terminal in response to the voltage of the first node; and a stabilization module, electrically connected to the second node and the first voltage terminal, and configured to provide the voltage of the first voltage terminal to the first output terminal and the second output terminal respectively in response to the voltage of the second node, wherein:

a phase of a signal output from the second output module lags behind a phase of a signal output from the first output module, and does not overlap with the phase of the signal output from the first output module, and the stabilization module includes:

a first transistor, wherein a first terminal of the first transistor is electrically connected to the first voltage terminal, a second terminal of the first transistor is electrically connected to the first output terminal, and a control terminal of the first transistor is electrically connected to the second node;

a second transistor, wherein a first terminal of the second transistor is electrically connected to the first voltage terminal, a second terminal of the second transistor is electrically connected to the second output terminal, and a control terminal of the second transistor is electrically connected to the second node; and a first capacitor, wherein a first plate of the first capacitor is electrically connected to the first voltage terminal, and a second plate of the first capacitor is electrically connected to the second node, the first output module includes:

a third transistor, wherein a first terminal of the third transistor is electrically connected to the first output terminal, and a second terminal of the third transistor is electrically connected to the second clock signal terminal; and a second capacitor, wherein a first plate of the second capacitor is electrically connected to the first output terminal, and a second plate of the second capacitor is electrically connected to a control terminal of the third transistor; and the second output module includes:

a fourth transistor, wherein a first terminal of the fourth transistor is electrically connected to the second output terminal, and a second terminal of the fourth transistor is electrically connected to the third clock signal terminal; and a third capacitor, wherein a first plate of the third capacitor is electrically connected to the second output terminal, and a second plate of the third capacitor is electrically connected to a control terminal of the fourth transistor, and a capacitance of the third capacitor is greater than a capacitance of the second capacitor;

an initial signal line;

a first clock signal line;

a second clock signal line; and a third clock signal line, wherein:

the signal input terminal of a first-stage shift register is electrically connected to the initial signal line;

except for the first-stage shift register, the signal input terminal of each stage shift register is electrically connected to one of the second output terminal and the first output terminal of a previous stage shift register;

for a 3n-th stage shift register, a first clock signal terminal thereof is electrically connected to the first clock signal line, a second clock signal terminal thereof is electrically connected to the second clock signal line, and a third clock signal terminal thereof is electrically connected to the third clock signal line;

for a 3n+1st stage shift register, a first clock signal terminal thereof is electrically connected to the third clock signal line, a second clock signal terminal thereof is electrically connected to the first clock signal line, and a third clock signal terminal thereof is electrically connected to the second clock signal line;

for a 3n+2nd stage shift register, a first clock signal terminal thereof is electrically connected to the second clock signal line, a second clock signal terminal thereof is electrically connected to the third clock signal line, and a third clock signal terminal thereof is electrically connected to the first clock signal line; and pulses of the first clock signal line, the second clock signal line, and the third clock signal line do not overlap with each other, and are arranged sequentially in time, wherein:

n is 0 or a positive integer.

15. A display panel, comprising:

a scan driving circuit, wherein the scan driving circuit includes:

shift registers, arranged in a cascaded manner, wherein each of the shift registers includes:

an input module, electrically connected to a signal input terminal and a first clock signal terminal, and configured to provide a signal of the signal input terminal to a first node in response to a signal of the first clock signal terminal;

a control module, electrically connected to a first voltage terminal, a second clock signal terminal, and a second node, and configured to provide a voltage of the first voltage terminal to the first node in response to a voltage of the second node and a signal of the second clock signal terminal;

a reset module, electrically connected to a second voltage terminal and the first clock signal terminal, and configured to provide a voltage of the second voltage terminal to the second node in response to the signal of the first clock signal terminal;

a first output module, electrically connected to the first node and the second clock signal terminal, and configured to provide the signal of the second clock signal terminal to a first output terminal in response to the voltage of the first node;

a second output module, electrically connected to the first node and a third clock signal terminal, and configured to provide a signal of the third clock signal terminal to a second output terminal in response to the voltage of the first node; and a stabilization module, electrically connected to the second node and the first voltage terminal, and configured to provide the voltage of the first voltage terminal to the first output terminal and the second output terminal respectively in response to the voltage of the second node, wherein:

a phase of a signal output from the second output module lags behind a phase of a signal output from the first output module, and does not overlap with the phase of the signal output from the first output module, and the stabilization module includes:

a first transistor, wherein a first terminal of the first transistor is electrically connected to the first voltage terminal, a second terminal of the first transistor is electrically connected to the first output terminal, and a control terminal of the first transistor is electrically connected to the second node;

a second transistor, wherein a first terminal of the second transistor is electrically connected to the first voltage terminal, a second terminal of the second transistor is electrically connected to the second output terminal, and a control terminal of the second transistor is electrically connected to the second node; and a first capacitor, wherein a first plate of the first capacitor is electrically connected to the first voltage terminal, and a second plate of the first capacitor is electrically connected to the second node, the first output module includes:

a third transistor, wherein a first terminal of the third transistor is electrically connected to the first output terminal, and a second terminal of the third transistor is electrically connected to the second clock signal terminal; and a second capacitor, wherein a first plate of the second capacitor is electrically connected to the first output terminal, and a second plate of the second capacitor is electrically connected to a control terminal of the third transistor; and the second output module includes:

a fourth transistor, wherein a first terminal of the fourth transistor is electrically connected to the second output terminal, and a second terminal of the fourth transistor is electrically connected to the third clock signal terminal; and a third capacitor, wherein a first plate of the third capacitor is electrically connected to the second output terminal, and a second plate of the third capacitor is electrically connected to a control terminal of the fourth transistor, and a capacitance of the third capacitor is greater than a capacitance of the second capacitor;

an initial signal line;

a first clock signal line;

a second clock signal line; and a third clock signal line, wherein:

the signal input terminal of a first-stage shift register is electrically connected to the initial signal line;

except for the first-stage shift register, the signal input terminal of each stage shift register is electrically connected to one of the second output terminal and the first output terminal of a previous stage shift register;

for a 3n-th stage shift register, a first clock signal terminal thereof is electrically connected to the first clock signal line, a second clock signal terminal thereof is electrically connected to the second clock signal line, and a third clock signal terminal thereof is electrically connected to the third clock signal line;

for a 3n+1st stage shift register, a first clock signal terminal thereof is electrically connected to the third clock signal line, a second clock signal terminal thereof is electrically connected to the first clock signal line, and a third clock signal terminal thereof is electrically connected to the second clock signal line;

for a 3n+2nd stage shift register, a first clock signal terminal thereof is electrically connected to the second clock signal line, a second clock signal terminal thereof is electrically connected to the third clock signal line, and a third clock signal terminal thereof is electrically connected to the first clock signal line; and pulses of the first clock signal line, the second clock signal line, and the third clock signal line do not overlap with each other, and are arranged sequentially in time, wherein:

n is 0 or a positive integer;

a plurality of scan signal lines; and a plurality of pixel driving circuits, wherein:

the first output terminal and the second output terminal of the shift registers of the scan driving circuit are electrically connected to the plurality of scan signal lines; and the plurality of scan signal lines is electrically connected to the plurality of pixel driving circuits.

16. A display device, comprising:

the display panel according to claim 15.

* * * * *